US008871053B2

(12) United States Patent
Sealey et al.

(10) Patent No.: US 8,871,053 B2
(45) Date of Patent: Oct. 28, 2014

(54) FIRE RETARDANT TREATED FLUFF PULP WEB

(71) Applicant: International Paper Company, Memphis, TN (US)

(72) Inventors: James E. Sealey, Anderson, SC (US); Brent A. Fields, Trenton, OH (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 14/192,920

(22) Filed: Feb. 28, 2014

(65) Prior Publication Data

US 2014/0174681 A1 Jun. 26, 2014

Related U.S. Application Data

(60) Division of application No. 13/751,218, filed on Jan. 28, 2013, now Pat. No. 8,685,206, which is a continuation of application No. PCT/US2011/046173, filed on Aug. 2, 2011.

(60) Provisional application No. 61/370,236, filed on Aug. 3, 2010.

(51) Int. Cl.

| | |
|---|---|
| ***D21H 21/34*** | (2006.01) |
| ***D21H 11/16*** | (2006.01) |
| ***D21H 21/14*** | (2006.01) |
| ***D21H 21/24*** | (2006.01) |
| ***D21H 15/04*** | (2006.01) |

(52) U.S. Cl.

CPC ..... *D21H 21/14* (2013.01); *D21H 21/24* (2013.01); *D21H 21/34* (2013.01); *D21H 15/04* (2013.01); *Y10S 428/92* (2013.01)

USPC ..... 162/159; 162/9; 162/141; 162/158; 162/181.2; 428/340; 428/920

(58) Field of Classification Search

CPC ..... D21H 21/34; D21H 17/07; D21H 17/66; D21H 17/10; D21H 17/11; D21H 21/24; D21H 17/63; D21H 11/16; D21H 15/04; Y10S 428/92

USPC ..... 162/9, 141, 149, 158, 159, 164.1, 162/164.6, 168.1–168.2, 166, 183–185, 162/181.1–181.2; 8/116.1; 428/212, 340, 428/920

See application file for complete search history.

(56) References Cited

U.S. PATENT DOCUMENTS

| | | | |
|---|---|---|---|
| 1,382,618 | A | 6/1921 | Blenio |
| 2,654,295 | A | 10/1953 | Sutherland |

(Continued)

FOREIGN PATENT DOCUMENTS

| | | |
|---|---|---|
| EP | 0132128 | 1/1985 |
| GB | 2209352 | 5/1989 |

(Continued)

OTHER PUBLICATIONS

Flame Retardants for Plastics and texiles, Weil, et al, Hanser Publishers, Munich 2009, p. 4-8.

(Continued)

*Primary Examiner* — Jose Fortuna
(74) *Attorney, Agent, or Firm* — Thomas W. Barnes, III

(57) ABSTRACT

A fire resistant fluff pulp web made from a fluff pulp web, a fire retardant component present in and/or on the fluff pulp, and a fire retardant distributing surfactant which distributes the fire retardant component in and/or on the fluff pulp web in a manner so that the fluff pulp web passes one or more fire resistance tests. Also, a process for preparing these fire resistant fluff pulp webs, as well as for treating outer fibrous layers comprising an air-laid mixture of these fire resistant fluff pulp fibers and bicomponent fibers with up to about 5% additional fire retardant and which are used in fire resistant air-laid fibrous structures useful in upholstery, cushions, mattress ticking, panel fabric, padding, bedding, insulation, materials for parts in devices and appliances, etc.

27 Claims, 5 Drawing Sheets

(56) References Cited

U.S. PATENT DOCUMENTS

| | | | |
|---|---|---|---|
| 2,832,745 | A | 4/1958 | Hechenblefkner |
| 2,982,482 | A | 5/1961 | Curtis |
| 3,049,307 | A | 8/1962 | Dalzell, Jr |
| 3,591,450 | A | 7/1971 | Murphy et al. |
| 3,815,834 | A | 6/1974 | Gilbert |
| 3,900,327 | A | 8/1975 | Miller |
| 3,955,032 | A | 5/1976 | Mischutin |
| 3,972,092 | A | 8/1976 | Wood |
| 4,026,808 | A | 5/1977 | Duffy |
| 4,060,450 | A | 11/1977 | Palazzolo et al. |
| 4,065,347 | A | 12/1977 | Aberg et al. |
| 4,075,136 | A | 2/1978 | Schaper |
| 4,081,316 | A | 3/1978 | Aberg et al. |
| 4,118,531 | A | 10/1978 | Hauser |
| 4,168,175 | A | 9/1979 | Shutt |
| 4,184,969 | A | 1/1980 | Bhat |
| 4,212,675 | A | 7/1980 | Robinson |
| 4,394,413 | A | 7/1983 | Westhead |
| 4,425,186 | A | 1/1984 | May et al. |
| 4,595,414 | A | 6/1986 | Shutt |
| 4,600,606 | A | 7/1986 | Mischutin |
| 4,602,982 | A | 7/1986 | Samuelson |
| 4,702,861 | A | 10/1987 | Farnum |
| 4,725,382 | A | 2/1988 | Lewchalermwong |
| 5,011,091 | A | 4/1991 | Kopecky |
| 5,064,710 | A | 11/1991 | Gosz |
| 5,076,969 | A | 12/1991 | Fox |
| 5,155,964 | A | 10/1992 | Fortin et al. |
| 5,252,754 | A | 10/1993 | Bottorff |
| 5,262,005 | A | 11/1993 | Ericksson et al. |
| 5,272,852 | A | 12/1993 | Fortin et al. |
| 5,328,759 | A | 7/1994 | McCormack et al. |
| 5,405,555 | A | 4/1995 | Riker |
| 5,491,186 | A | 2/1996 | Kean et al. |
| 5,516,580 | A | 5/1996 | Frenette et al. |
| 5,534,301 | A | 7/1996 | Shutt |
| 5,554,238 | A | 9/1996 | English |
| 5,642,601 | A | 7/1997 | Thompson, Jr. et al. |
| 5,723,020 | A | 3/1998 | Robinson et al. |
| 5,786,059 | A | 7/1998 | Frank et al. |
| 5,858,530 | A | 1/1999 | McCullough, Jr. |
| 5,886,306 | A | 3/1999 | Patel et al. |
| 5,910,367 | A | 6/1999 | Kean et al. |
| 5,935,880 | A | 8/1999 | Wang et al. |
| 5,990,377 | A | 11/1999 | Chen et al. |
| 6,025,027 | A | 2/2000 | Shutt |
| 6,059,924 | A | 5/2000 | Hoskins |
| 6,162,329 | A | 12/2000 | Vinson et al. |
| 6,372,360 | B1 | 4/2002 | Blunden et al. |
| 6,589,643 | B2 | 7/2003 | Okada et al. |
| 6,719,862 | B2 | 4/2004 | Quick et al. |
| 6,733,697 | B2 | 5/2004 | Rhodes et al. |
| 6,808,790 | B2 | 10/2004 | Chen et al. |
| 6,867,154 | B1 | 3/2005 | Lunsford et al. |
| 6,982,049 | B1 | 1/2006 | Mabey et al. |
| 6,989,113 | B1 | 1/2006 | Mabey |
| 7,144,474 | B1 | 12/2006 | Hansen et al. |
| 7,381,300 | B2 | 6/2008 | Skaggs et al. |
| 7,549,853 | B2 | 6/2009 | Fegelman et al. |
| 7,604,715 | B2 | 10/2009 | Liesen et al. |
| 7,622,517 | B2 | 11/2009 | Bauer et al. |
| 7,638,016 | B2 | 12/2009 | Nguyen |
| 7,674,522 | B2 | 3/2010 | Pohlmann |
| 7,744,143 | B2 | 6/2010 | Gladfelter et al. |
| 7,837,009 | B2 | 11/2010 | Gross et al. |
| 8,043,384 | B2 | 10/2011 | Gagnon et al. |
| 8,388,807 | B2 | 3/2013 | Sealey et al. |
| 8,535,482 | B2 | 9/2013 | Jiang et al. |
| 8,685,206 | B2 * | 4/2014 | Sealey et al. ..... 162/159 |
| 2002/0099347 | A1 | 7/2002 | Chen et al. |
| 2003/0070780 | A1 | 4/2003 | Chen et al. |
| 2004/0099178 | A1 | 5/2004 | Jones et al. |
| 2006/0185808 | A1 | 8/2006 | Nguyen |
| 2007/0202771 | A1 | 8/2007 | Douglass et al. |
| 2007/0209307 | A1 | 9/2007 | Andersen |
| 2008/0050565 | A1 | 2/2008 | Gross et al. |
| 2008/0121461 | A1 | 5/2008 | Gross et al. |
| 2008/0211253 | A1 | 9/2008 | Gladfelter et al. |
| 2009/0068430 | A1 | 3/2009 | Troger et al. |
| 2009/0176074 | A1 | 7/2009 | Sotendahl et al. |
| 2010/0066121 | A1 | 3/2010 | Gross |
| 2010/0168286 | A1 | 7/2010 | Gladfelter et al. |
| 2010/0252213 | A1 | 10/2010 | Nguyen |
| 2011/0034891 | A1 | 2/2011 | Jiang et al. |
| 2011/0095245 | A1 | 4/2011 | Munson et al. |
| 2011/0117354 | A1 | 5/2011 | Gagnon et al. |
| 2012/0048493 | A1 | 3/2012 | Sealey |
| 2012/0199303 | A1 | 8/2012 | Sealey et al. |
| 2012/0255695 | A1 | 10/2012 | Sealey et al. |
| 2013/0133850 | A1 | 5/2013 | Sealey et al. |
| 2013/0153810 | A1 | 6/2013 | Sealey et al. |
| 2014/0000827 | A1 * | 1/2014 | Jiang et al. ..... 162/162 |

FOREIGN PATENT DOCUMENTS

| | | |
|---|---|---|
| WO | 8908137 | 9/1989 |
| WO | 9304239 | 3/1993 |
| WO | 9412725 | 6/1994 |
| WO | 9632459 | 10/1996 |
| WO | 0236517 | 5/2002 |
| WO | 2005012638 | 2/2005 |
| WO | 2005042859 | 5/2005 |
| WO | 20050274472 | 12/2005 |
| WO | 2006107847 | 10/2006 |
| WO | 2008005936 | 1/2008 |
| WO | 2012012316 | 1/2012 |
| WO | 2012108978 | 6/2012 |

OTHER PUBLICATIONS

Smook Handbook, p. 336 and 342, Chap 7 p. 74-83,Chap 18 p. 283-296, 1992.

* cited by examiner

FIRE RETARDANT TREATED FLUFF PULP WEB

CROSS REFERENCE TO RELATED APPLICATIONS

This application is a divisional application of U.S. patent application Ser. No. 13/751,218 filed on Jan. 28, 2013, now U.S. Pat. No. 8,685,206, which is a Continuation of PCT/US2011/046173 filed on Aug. 2, 2011, which claims the benefit of U.S. provisional application No. 61/370,236 filed on Aug. 3,2010.

FIELD OF THE INVENTION

The present invention broadly relates to a fire resistant fluff pulp web comprising a fluff pulp web, a fire retardant component present in and/or on the fluff pulp, and a fire retardant distributing surfactant which distributes the fire retardant component in and/or on the fluff pulp web in a manner so that the fluff pulp web passes one or more fire resistance tests. The present invention also broadly relates to a process for preparing these fire resistant fluff pulp webs. The present invention further relates to a process for treating outer fibrous layers comprising an air-laid mixture of fire resistant fluff pulp fibers and bicomponent fibers with up to about 5% additional fire retardant and which may be used in fire resistant air-laid fibrous structures useful in upholstery, cushions, mattress ticking, panel fabric, padding, bedding, insulation, materials for parts in devices or appliances, etc.

BACKGROUND

Fire resistant fibrous materials may be used in upholstery, cushions, mattress ticking, panel fabric, padding, bedding, insulation, materials for parts in devices or appliances, etc. Such materials may be formed from natural and/or synthetic fibers, and then treated with fire retardant chemicals which may include halogen-based and/or phosphorous-based chemicals, along with certain metal oxides such as ferric oxide, stannic oxide, antimony trioxide, titanium dioxide, etc. These fire resistant materials may be produced by depositing these metal oxides, within or on the fibers, for example, by the successive precipitation of ferric oxides and a mixture of tungstic acid and stannic oxide, by the successive deposition of antimony trioxide and stannic oxide, by the successive deposition of antimony trioxide and titanium dioxide. In another process for imparting fire retardancy to such materials, a single processing bath may be used wherein a dispersion of a chlorinated hydrocarbon and finely divided antimony oxide is padded on the fabric material. Near the fibrous material's combustion temperature, the antimony oxide reacts with hydrogen chloride (generated by degradation of the chlorinated hydrocarbon) to form antimony oxychloride which acts to suppress the flame.

In another process for making such fibrous materials semi-permanently to permanently fire resistant, the fire retardant chemicals may be reacted with the cellulose or protein functionalities of the natural fibers in the material. For example, the cellulose in the fabric fibers may be esterified with diammonium hydrogen orthophosphate. Alternatively, amidophosphates may be reacted with trimethylol melamine to form a thermosetting resin within the fibrous materials (see U.S. Pat. No. 2,832,745 (Hechenblefkner), issued Apr. 29, 1958) or a phosphorous containing N-hydroxy-methyl amide and tetrakis(hydroxymethyl)phosphonium chloride may be incorporated in the fibrous materials by thermal induced pad curing (see U.S. Pat. No. 4,026,808 (Duffy), issued May 31, 1977).

Fire retardant chemicals may also be coated onto the fibrous materials. See, for example, U.S. Pat. No. 3,955,032 (Mischutin), issued May 4, 1976, which discloses a process using chlorinated-cyclopentadieno compounds and chlorobrominated-cyclpentadieno compounds, either alone or in combination with metal oxides, which are suspended in a latex medium and then cured to render natural and synthetic fibrous materials and blends of thereof fire retardant. See also U.S. Pat. No. 4,600,606 (Mischutin), issued Jul. 15, 1986, which discloses a method for flame retarding textile and related fibrous materials which uses a water-insoluble, non-phosphorous containing brominated aromatic or cycloaliphatic compounds along with a metal oxide to treat fabrics for protection against splashes of molten metals or glass, as well as a U.S. Pat. No. 4,702,861 (Farnum), issued Oct. 27, 1987, which discloses a flame retardant composition comprising a dispersion of phosphorous-containing compounds and metal oxides in latex which, upon exposure to elevated temperatures and/or flame, reportedly creates a substantially continuous protective film generally encapsulating and/or enveloping the surface of the article onto which it is applied, the film-forming materials being based upon an aqueous latex dispersion of polyvinylchloride-acrylic copolymer, which is inherently fire retardant.

SUMMARY

According to a first broad aspect of the present invention, there is provided an article comprising a fire resistant fluff pulp web comprising:

- a fluff pulp web comprising above about 45% unrefined softwood fibers and having:
  - a basis weight above about 40 gsm;
  - a caliper of at least about 30 mils;
  - a fiberization energy of less than about 170 kJ/kg;
  - a moisture content of less than about 16%; and
- a fire retardant component present in and/or on the fluff pulp web in an amount of up to about 150 lbs fire retardant component per ton of the fluff pulp web, the fire retardant component comprising:
  - from about 50 to about 98.5% by weight of the fire retardant component of one or more retardants; and
  - from about 1.5 to about 50% by weight of the fire retardant component of one or more organic amine fire retardant dispersants; and
- one or more fire retardant distributing surfactants which distribute the fire retardant component in and/or on the fluff pulp web;
- wherein the fire retardant component is in an amount and is distributed in and/or on the fluff pulp web in a manner so that the fire resistant fluff pulp web passes one or more of the following tests: the UL 94 TMVB test, or the Horizontal Burn Through test.

According to a second broad aspect of the present invention, there is provided a process comprising the following steps:

a. providing a fluff pulp web comprising above about 45% unrefined softwood fibers and having:
   - a basis weight above about 40 gsm;
   - a caliper of at least about 30 mils;
   - a fiberization energy of less than about 170 kJ/kg; and
   - a moisture content of less than about 16%; and b. treating the fluff pulp web with a fire retardant component in an amount up to about 150 lbs fire retardant component per ton of the fluff pulp web in the presence of one or more fire retardant distributing surfactants which distribute the fire retardant in and/or on the fluff pulp web in a manner so that the treated fluff pulp web provides a fire resistant fluff pulp web which passes one or more of the following tests: the UL 94 TMVB test, or the Horizontal Burn Through test, wherein the fire retardant component comprises:

from about 50 to about 98.5% by weight of the fire retardant component of one or more fire retardants; and from about 1.5 to about 50% by weight of the fire retardant component of one or more organic amine fire retardant dispersants.

According to a third broad aspect of the present invention, there is provided a process comprising the following steps:

a. providing at least one fire resistant outer layer positioned over an upper surface and/or under a lower surface of an air-laid fibrous core; and b. treating the at least one fire resistant outer layer with a fire retardant composition comprising one or more first fire retardants in an amount sufficient to provide up to about 5% of the first fire retardants by weight of the at least one fire resistant outer layer and sufficient to pass one or more of the following tests: the UL 94 TMVB test, or the Horizontal Burn Through test;

wherein the at least one outer layer comprises:

from about 50 to about 95% by weight of the at least one outer layer of comminuted fire resistant fluff pulp fibers; and from about 5 to about 50% by weight of the at least one outer layer of bicomponent fibers;

wherein the fire resistant fluff pulp fibers comprise above about 45% unrefined softwood fibers and having:

a basis weight above about 40 gsm;

a caliper of at least about 30 mils;

a fiberization energy of less than about 170 kJ/kg; and a moisture content of less than about 16%;

wherein the fluff pulp fibers are treated with a fire retardant component in an amount up to about 150 lbs fire retardant component per ton of the fluff pulp fibers in the presence of a fire retardant distributing surfactant and;

wherein the fire retardant component comprises:

from about 50 to about 98.5% by weight of the fire retardant component of one or more second fire retardants; and from about 1.5 to about 50% by weight of the fire retardant component of one or more organic amine fire retardant dispersants.

BRIEF DESCRIPTION OF THE DRAWINGS

The invention will be described in conjunction with the accompanying drawings, in which.

DETAILED DESCRIPTION

Figure 1:
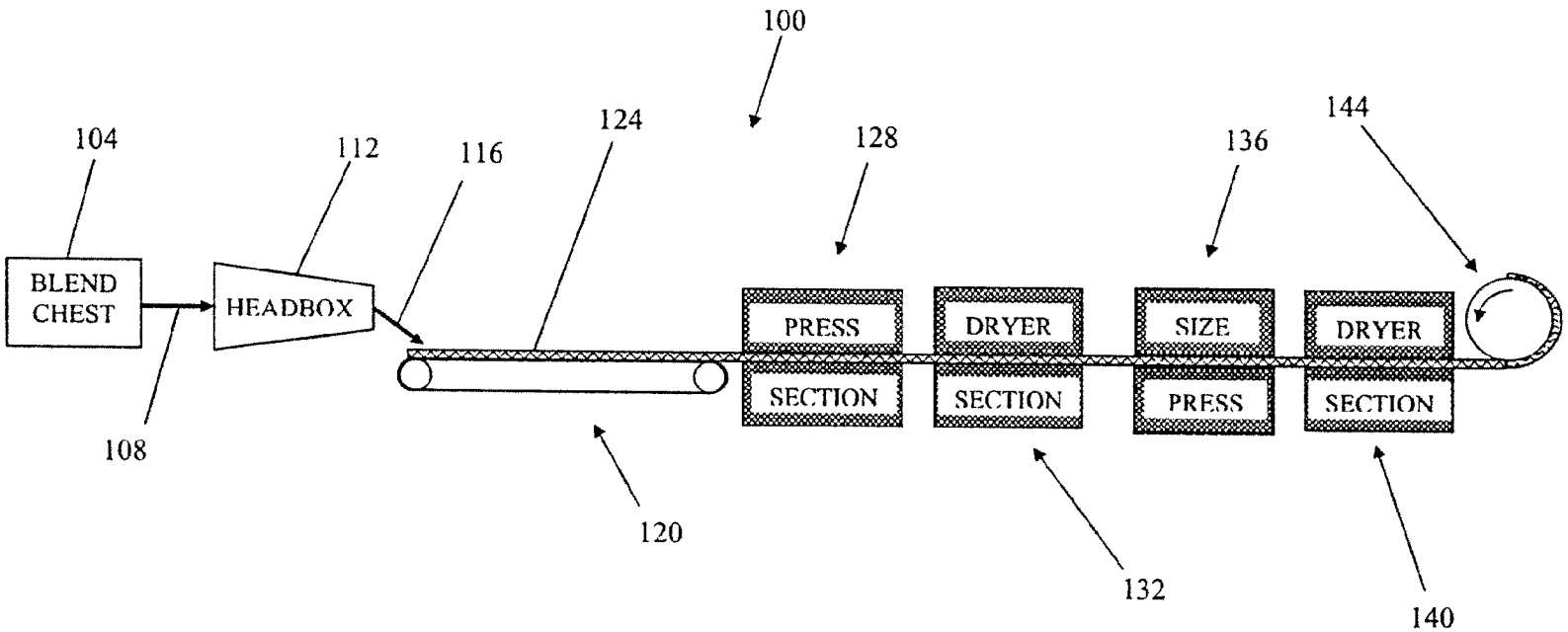
FIG. 1 is a schematic diagram which shows an illustrative process for providing a fire resistant fluff pulp web according to an embodiment of the present invention.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "top", "bottom", "side," "front," "frontal," "forward," "rear," "rearward," "back," "trailing," "above", "below", "left", "right", "horizontal", "vertical", "upward", "downward", etc. are merely used for convenience in describing the various embodiments of the present invention. The embodiments shown in FIGS. 1 through 5 may be flipped over, rotated by 90° in any direction, etc.

For the purposes of the present invention, the term "fluff pulp" refers to a fibrous cellulosic matrix comprising wood pulp fibers which may be comminuted to provide an air-laid fibrous structure. Fluff pulps may also be referred to as "fluffy pulp," or "comminution pulp." Some illustrative examples of commercially available fluff pulp may include one or more of: RW Supersoft™, Supersoft L™, RW Supersoft Plus™, GT Supersoft Plus™, RW Fluff LITE™, RW Fluff 110™, RW Fluff 150™, RW Fluff 160™, GP 4881™, GT Pulp™, RW SSP™, GP 4825™, etc.

For the purposes of the present invention, the term "softwood fibers" refers to fibrous pulps derived from the woody substance of coniferous trees (gymnosperms) such as varieties of fir, spruce, pine, etc., for example, loblolly pine, slash pine, Colorado spruce, balsam fir, Douglas fir, jack pine, radiata pine, white spruce, lodgepole pine, redwood, etc. North American southern softwoods and northern softwoods may be used to provide softwood fibers, as well as softwoods from other regions of the world.

For the purposes of the present invention, the term "hardwood fibers" refers to fibrous pulps derived from the woody substance of deciduous trees (angiosperms) such as birch, oak, beech, maple, eucalyptus, poplars, etc.

For the purposes of the present invention, the term "unrefined fibers" refers to pulp fibers which have not been refined, i.e., have not be subjected to a process of mechanical treatment, such as beating, to develop or modify the pulp fibers, often to increase fiber bonding strength and/or improve surface properties. See G. A. Smook, Handbook for Pulp and Paper Technologists ($2^{nd}$ Edition, 1992), page 191-202, the entire contents and disclosure of which is herein incorporated by reference, for a general description of the refining of pulp fibers.

For the purposes of the present invention, the term "fluff pulp web" refers to fluff pulp in the form of, for example, sheets, strips, pieces, etc., which may be in the form of a continuous roll, a discrete sheet, etc.

For the purposes of the present invention, the term "basis weight," refers to the grammage of the pulp fibers, pulp web, etc., as determined by TAPPI test T410. See G. A. Smook, Handbook for Pulp and Paper Technologists ($2^{nd}$ Edition, 1992), page 342, Table 22-11, the entire contents and disclosure of which is herein incorporated by reference, which describes the physical test for measuring basis weight.

For the purposes of the present invention, the term "basis weight variability," refers to the statistical variation from the target basis weight value. For example, if the target basis weight is 750 gsm and the area of the sample being evaluated is 755 gsm, the basis weight variability would be 0.06%. Basis weight variability may be measured in the machine direction (MD) or the cross machine direction (CD).

For the purposes of the present invention, the term "caliper," refers to the thickness of a web (e.g., fluff pulp web) in mils, as determined by measuring the distance between smooth, flat plates at a defined pressure.

For the purposes of the present invention, the term "moisture content," refers to the amount of water present in the fluff pulp web as measured by TAPPI test T210 cm-03.

For the purposes of the present invention, the term "fiberization energy," (also sometimes called the "shred energy") refers to the amount of energy (in kJ/kg) required to comminute (e.g., defiberize, disintegrate, shred, fragment, etc.) a fluff pulp web to individualized fluff pulp fibers by using a hammermill (such as a Kamas Type H 01 Laboratory Defribrator manufactured by Kamas Industri AB). The energy required to comminute the fluff pulp web is normally measured and displayed by the hammermill in, for example, watt hours (wH). The fiberization energy may be calculated by using the following equation: fiberization energy (in kJ/kg)= 3600×energy measured (in wH)÷fiberized fiber weight (in grams). See U.S. Pat. No. 6,719,862 (Quick et al.), issued Apr. 13, 2004, the entire contents and disclosure of which is incorporated by reference, especially column 11, lines 25-32.

For the purposes of the present invention, the term "fluff pulp filler" refers commonly to mineral products (e.g., calcium carbonate, kaolin clay, calcium sulfate hemihydrate, calcium sulfate dehydrate, chalk, etc.) which may be used in fluff pulp making to reduce materials cost per unit mass of the pulp, increase opacity, etc. These mineral products may be finely divided, for example, in the size range of from about 0.5 to about 5 microns.

For the purposes of the present invention, the term "fluff pulp pigment" refers to a material (e.g., a finely divided particulate matter) which may be used or may be intended to be used to affect optical properties of fluff pulp, fluff pulp web, etc. Fluff pulp pigments may include one or more of: calcium carbonate, kaolin clay, calcined clay, modified calcined clay, aluminum trihydrate, titanium dioxide, talc, plastic pigment, amorphous silica, aluminum silicate, zeolite, aluminum oxide, colloidal silica, colloidal alumina slurry, etc.

For the purposes of the present invention, the term "calcium carbonate" refers various calcium carbonates which may be used as fluff pulp pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a fluff pulp pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "fluff pulp binders" refers to a binder agent for fluff pulp fibers which may be used to improve the binding strength of the fluff pulp fibers in the web. Suitable fluff pulp binders may include one or more synthetic or naturally occurring polymers (or a combination of different polymers), for example, a polyvinyl alcohol (PVOH), polyacrylamide, modified polyacrylamide, starch binders, proteinaceous adhesives such as, for example, casein or soy proteins, etc.; polymer latexes such as styrene butadiene rubber latexes, acrylic polymer latexes, polyvinyl acetate latexes, styrene acrylic copolymer latexes, wet strength resins such as Amres (a Kymene type), Bayer Parez, etc., polychloride emulsions, polyols, polyol carbonyl adducts, ethanedial/polyol condensates, polyamides, epichlorohydrin, glyoxal, glyoxal ureas, aliphatic polyisocyanates, 1,6 hexamethylene diisocyanates, polyesters, polyester resins, etc.

For the purposes of the present invention, the term "air-laid fibrous structure" refers to a nonwoven, bulky, porous, soft, fibrous structure obtained by air-laying comminuted fluff pulp web and/or fluff pulp fibers, and which may optionally comprise synthetic fibers such as bicomponent fibers. Air-laid fibrous structures may include air-laid fibrous cores, air-laid fibrous layers, etc.

For the purposes of the present invention, the term "comminuting" refers to defibrizing, disintegrating, shredding, fragmenting, etc., a fluff pulp web and/or fluff pulp fibers to provide an air-laid structure.

For the purposes of the present invention, the term "synthetic fibers" refers to fibers other than wood pulp fibers (e.g., other than fluff pulp fibers) and which be made from, for example, cellulose acetate, acrylic, polyamides (such as, for example, Nylon 6, Nylon 6/6, Nylon 12, polyaspartic acid, polyglutamic acid, etc.), polyamines, polyimides, polyamides, polyacrylics (such as, for example, polyacrylamide, polyacrylonitrile, esters of methacrylic acid and acrylic acid, etc.), polycarbonates (such as, for example, polybisphenol A carbonate, polypropylene carbonate, etc.), polydienes (such as, for example, polybutadiene, polyisoprene, polynorbomene, etc.), polyepoxides, polyesters (such as, for example, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, etc.), polyethers (such as, for example, polyethylene glycol(polyethylene oxide), polybutylene glycol, polypropylene oxide, polyoxymethylene (paraformaldehyde), polytetramethylene ether(polytetrahydrofuran), polyepichlorohydrin, and so forth), polyfluorocarbons, formaldehyde polymers (such as, for example, urea-formaldehyde, melamine-formaldehyde, phenol formaldehyde, etc.), polyolefins (such as, for example, polyethylene, polypropylene, polybutylene, polybutene, polyoctene, etc.), polyphenylenes (such as, for example, polyphenylene oxide, polyphenylene sulfide, polyphenylene ether sulfone, etc.), silicon containing polymers (such as, for example, polydimethyl siloxane, polycarbomethyl silane, etc.), polyurethanes, polyvinyls (such as, for example, polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone, etc.), polyacetals, polyarylates, and copolymers (such as, for example, polyethylene-co-vinyl acetate, polyethylene-co-acrylic acid, polybutylene terephthalate-co-polyethylene terephthalate, polylauryllactam-block-polytetrahydrofuran, vinyl chloride, regenerated cellulose such as viscose rayon, glass fibers, ceramic fibers, bicomponent fibers, melamine fibers (e.g., fibers obtained from melamine-formaldehyde resin), etc.

For the purposes of the present invention, the term "bicomponent fibers" refers to fibers comprising a core and sheath configuration. The core and sheath portions of bicomponent fibers may be made from various polymers. For example, bicomponent fibers may comprise a PE (polyethylene) or modified PE sheath which may have a PET (polyethylene terephthalate) or PP (polypropylene) core. In one embodiment, the bicomponent fiber may have a core made of polyester and sheath made of polyethylene. Alternatively, a multicomponent fiber with a PP (polypropylene) or modified PP or PE sheath or a combination of PP and modified PE as the sheath or a copolyester sheath wherein the copolyester is isophthalic acid modified PET (polyethylene terephthalate) with a PET or PP core, or a PP sheath-PET core and PE sheath-PP core and co-PET sheath fibers may be employed. Various geometric configurations may be used for the bicomponent fiber, including concentric, eccentric, islands-in-the-sea, side-by-side, etc. The relative weight percentages and/or proportions of the core and sheath portions of the bicomponent fiber may also be varied.

For the purposes of the present invention, the term "trivalent metal" refers to a metal which may have a positive charge of three (e.g., boron, zinc, an iron (ferric), cobalt, nickel, aluminum, manganese, chromium, etc.), and may include combinations of one or more of these trivalent metals. Sources of trivalent metals may include one or more of organic or inorganic salts, for example, from one or more of the following anions: acetate, lactate, EDTA, halide, chloride, bromide, nitrate, chlorate, perchlorate, sulfate, acetate, carboxylate, hydroxide, nitrite, etc. The salt may be a simple salt, wherein the trivalent metal forms a salt with one or more of the same anion, or a complex salt, wherein the trivalent metal forms a salt with two or more different anions. In one embodiment, the salt may be aluminum chloride, aluminum carbonate, aluminum sulfate, alum (e.g., aluminum ammonium sulfate, aluminum potassium sulfate, aluminum sulfate, etc.), etc.

For the purposes of the present invention, the term "debonder surfactant" refers to surfactants which are useful in the treatment of cellulose pulp, such as fluff pulp, to reduce inter-fiber bonding. Suitable debonder surfactants may include one or more of: cationic surfactants or nonionic surfactants, such as linear or branched monoalkyl amines, linear or branched dialkyl amines, linear or branched tertiary alkyl amines, linear or branched quaternary alkyl amines, linear or branched, saturated or unsaturated hydrocarbon surfactants, fatty acid amides, fatty acid amide quaternary ammonium salts, dialkyl dimethyl quaternary ammonium salts, dialkylimidazolinium quaternary ammonium salts, dialkyl ester quaternary ammonium salts, triethanolamine-ditallow fatty acids, fatty acid ester of ethoxylated primary amines, ethoxylated quaternary ammonium salts, dialkyl amide of fatty acids, dialkyl amide of fatty acids, ethoxylated alcohols, such as $C_{16}$-$C_{18}$ unsaturated alkyl alcohol ethoxylates, commercially available compound having CAS Registry No. 68155-01-1, commercially available compound having CAS Registry No. 26316-40-5, commercially available Eka Chemical F60™ (an ethoxylated alcohol surfactant), commercially available Cartaflex TS LIQ™, commercially available F639™, commercially available Hercules PS9456™, commercially available Cellulose Solutions 840™, commercially available Cellulose Solutions 1009™, commercially available EKA 509H™, commercially available EKA 639™, etc. See also U.S. Pat. No. 4,425,186 (May et al.), issued Jan. 10, 1984, the entire contents and disclosure of which is hereby incorporated by reference, which discloses a combination of a cationic surfactant and a dimethylamide of a straight chain carbon carboxylic acid containing 12 to 18 carbon atoms which may be useful as a debonder surfactant.

For the purposes of the present invention, the term "fire resistant article" refers to an article (e.g., fluff pulp, fluff pulp web, air-laid structure, etc.) which has been treated with a fire retardant in an amount sufficient to make the treated material resistant to fire, flame, burning, etc., as determined by certain fire resistance test(s), such as the UL 94 test, the Horizontal Burn Through method test, etc.

For the purposes of the present invention, the term "fire resistance test" refers to a test which measures the fire resistant characteristics, properties, etc., of an article, a material, etc. These tests may include the UL 94 test, the Horizontal Burn Through method test, etc.

For the purposes of the present invention, the term "UL 94 test" (also known as the cigarette test") refers to a fire resistance test (authored by Underwriters Laboratories) which is used to measure the flammability of articles, such as plastics, materials for parts in devices or appliances, etc. The UL 94 test measures the ability of such articles to prevent flame propagation. The UL 94 test may be conducted on specimens which are 200 (±5) mm long×50 (±5) mm wide and having a minimum/maximum covering the thickness range of materials to be tested. For the purposes of the present invention, the UL 94 test may be carried out using the UL 94 TMVB test method (also known as the "Thin Material Vertical Burning Test"). See pages 24-27, UL 94 "Tests for Flammability of Plastic Materials for Parts in Devices and Appliances" published by Underwriters Laboratories Inc., Standard for Safety (2009), the entire contents and disclosure of which is herein incorporated by reference, for how to carry out the UL 94 TMVB test method, including apparatus used and specimen preparation. In the UL 94 TMVB test method, the specimens are clamped in a vertical orientation and then the free bottom end of the specimen is exposed to a nominal 50 W burner flame (20±1 mm flame height) so that the flame is applied to the specimen for 3±0.5 seconds (first flame application); once afterflaming ceases, the flame is applied to the specimen for an additional 3±0.5 seconds (second flame application). See procedure described in Section 11.5 at pages 26-27 of UL 94 "Tests for Flammability of Plastic Materials for Parts in Devices and Appliances" published by Underwriters Laboratories Inc., Standard for Safety (2009), the entire contents and disclosure of which is herein incorporated by reference. For the purposes of the present invention, an article may be considered to be fire resistant under the UL 94 TMVB test method if the 5 specimens tested satisfy the VTM-0 criteria (see Example 2 and Table 3 below) as shown in paragraph 11.1.3, Table 11.1, at page 24 of UL 94 "Tests for Flammability of Plastic Materials for Parts in Devices and Appliances" published by Underwriters Laboratories Inc., Standard for Safety (2009), the entire contents and disclosure of which is herein incorporated by reference. Specimen preparation for specimens used in carrying out the UL 94 TMVB test method according to the present invention are described in the section below entitled "Fire Resistant Test Specimen Preparation."

For the purposes of the present invention, the term "Horizontal Burn Through test" (also known as the "California test") refers to fire resistance test which measures the ability of the article being tested to resist burning by forming, for example, a stable char that insulates the remaining uncharred material of the article from heat. Articles, materials, etc., are considered to have passed the Horizontal Burn Through test is there is no burn through after the specimen being tested is exposed to a flame for at least 15 minutes. The Horizontal Burn Through test may be conducted on specimens which are 10 cm×10 cm square and which are then centrally positioned on a 6.35 mm (0.25 inch) thick square steel plate approximately 15 cm.times.15 cm (6.times.6 inches). The plate has a circular hole of a diameter of 50.8 mm (or 2 inches) machined concentrically through the center portion. The specimen is mounted level over a Bunsen burner which is fed with a natural gas flow rate of 415 ml/min so that when moved under the specimen, the tip of the flame just touches the underside of the barrier in the center of the hole, the flame being held in contact with the specimen for a total of 15 minutes after which the condition of the specimen is assessed for burn through. See paragraphs [0158]-[0160] of U.S. Pat. Appln. No. 20080050565 (Gross et al.), published Feb. 28, 2008, the entire disclosure and contents of which is herein incorporated by reference, which describes how to carry out the Horizontal Burn Through test. Specimen preparation for specimens used in carrying out the Horizontal Burn Through test method according to the present invention are described in the section below entitled "Fire Resistant Test Specimen Preparation."

For the purposes of the present invention, the term "fire retardant" refers to one or more substances (e.g., composition, compound, etc.) which are able to reduce, impart resistance to, etc., the flammability, the ability to burn, etc., of a material, article, etc. Fire retardants may include one or more of: phosphorous fire retardants, halogenated hydrocarbon fire retardants, metal oxide fire retardants, borate fire retardants (e.g., boric acid, borax, sodium tetraborate decahydrate, etc.), etc. For example, the fire retardant may comprise a mixture, blend, etc., of one or more phosphorous fire retardants, one or more halogenated hydrocarbon fire retardants, and one or more metal oxide fire retardants.

For the purposes of the present invention, the term "phosphorous fire retardant" refers to a fire retardant substance, compound, molecule, etc., which comprises one or more phosphorous atoms. Phosphorous fire retardants may include one or more of: phosphates, such as sodium phosphates, ammonium phosphates, sodium polyphosphates, ammonium polyphosphates, melamine phosphates, ethylenediamine phosphates etc.; red phosphorus; metal hypophosphites, such as aluminum hypophosphite and calcium hypophosphite; phosphate esters; etc. For embodiments of the present invention, the phosphorus fire retardant disperses on and/or in the cellulosic fibers and may, in some embodiments (e.g., ammonium phosphates) form a bond (i.e., crosslink) to cellulose which forms a stable char during exposure to the flame. Some proprietary phosphorous fire retardants may include, for example: Spartan™ AR 295 Flame Retardant from Spartan Flame Retardants Inc. of Crystal Lake, Ill., include both organic and inorganic constituents, GLO-TARD FFR2, which is an ammonium polyphosphate fire retardant from GLO-TEX International, Inc. of Spartanburg, S.C.; Fire Retard 3496, which is a phosphate ester supplied by Manufacturers Chemicals, L.P. of Cleveland, Tenn., Flovan CGN, a multi-purpose phosphate-based flame retardant supplied by Huntsman (Salt Lake City, Utah); SPARTAN™ AR 295, a diammonium phosphate based flame retardant from Spartan Flame Retardants, Inc. (Crystal Lake, Ill.), FRP 12™, FR 165™, and FR 8500™ supplied by Cellulose Solutions, LLC (Daphne, Ala.), etc.

For the purposes of the present invention, the term "halogenated organic fire retardant" refers to a halogenated organic compound which alone, or in combination with other substances, compounds, molecules, etc., are capable of functioning as a fire retardant. Halogenated organic fire retardants may include one or more of: halogenated (e.g., chlorinated, brominated, etc.) hydrocarbons, such as halogenated aliphatics (e.g., haloalkanes), halogenated aromatics, etc. Halogenated organic fire retardants may include chloroparaffins, Dechorane Plus (a chlorine-containing halogenated fire retardant), decabromodiphenyl oxide, tetradecabromodiphenoxybenzene, ethylenebispentabromobenzene (EBPB); tetrabromobisphenol A (TBBA), tetrabromobisphenol A bis-hexabromocyclododecane, ethylenebis-(tetrabromophthalimide). These halogenated organic fire retardants may work by eliminating oxygen from the burn zone which quenches, extinguishes, smothers, puts out, etc., the flame.

For the purposes of the present invention, the term "metal oxide fire retardant" refers to metal oxides which alone, or in combination with other substances, are capable of functioning as a fire retardant. Metal oxide fire retardants may include one or more of: aluminum oxide (alumina), antimony trioxide, ferric oxide, titanium dioxide, stannic oxide, etc.

For the purposes of the present invention, the term "organic amine fire retardant dispersants" refers to quaternary or non-quarternary organic amines which function to disperse, distribute, etc., the other fire retardant components (e.g., phosphorous fire retardants, halogenated organic fire retardants, metal oxide fire retardants, etc.) over, through, etc., the fibrous matrix of the fluff pulp web. These organic amine fire retardant dispersants may also enhance crosslinking of the other fire retardant components with the cellulose comprising fibers of the fluff pulp web. Suitable organic amine fire retardant dispersants may include one or more debonder surfactants as described above which are organic cationic quaternary amine or nonionic amine surfactants, etc. For example, suitable organic amine fire retardant dispersants may include one or more of: $C_{12}$-$C_{18}$ carbon chain length cationic quaternary amine and/or nonionic linear amine surfactants (in some embodiments, may also optionally include up to about 15% glycol or similar nonionic surfactant mixed in), such as an organic amine fire retardant dispersant comprising above about 25% $C_{18}$ carbon chain length quaternary amine surfactant (e.g., a very polar cationic surfactant).

For the purposes of the present invention, the term "fire retardant distributing surfactant" refers to surfactants which function to distribute, disperse, etc., the fire retardant over, through, etc., the fibrous matrix of the fluff pulp web. Suitable fire retardant distributing surfactants may be ionic or non-ionic, have a rheology which permits the surfactant to be dispersed on and/or through the fluff pulp web being treated with the fire retardant component, carries the fire retardant component on and/or through the fluff pulp web (i.e., the fire retardant component is not fully dissolved in the surfactant), enables or at least does not inhibit crosslinking between fire retardants (e.g., crosslinkable phosphorous fire retardants such as the ammonium phosphates) in the fire retardant component and the cellulosic fibers in the fluff pulp web, etc. Suitable fire retardant distributing surfactants may include one or more of: alkoxylated alcohols/alcohol alkoxylates (e.g., BASF's Plurafac® alcohol alkoxylates) which may include ethoxylated alcohols (e.g., Eka Chemical's F60 surfactant, etc. Suitable ethoxylated alcohols for use as fire retardant distributing surfactants may comprise from about 1 to about 30 ethylene oxide (EO) units, for example, from about 4 to about 25 EO units, with an alcohol carbon chain length of from about 6 to about 30 carbon atoms, for example, from about 6 to about 22 carbon atoms, such as from about 12 to about 18 carbon atoms (e.g., from about 16 to 18 carbon atoms). See U.S. Pat. No. 7,604,715 (Liesen et al.), issued Oct. 20, 2009, the entire contents and disclosure of which is incorporated by reference.

For the purposes of the present invention, the term "solids basis" refers to the weight percentage of each of the respective solid materials (e.g., fire retardants, surfactants, dispersants, etc.) present in the furnish, web, composition, etc., in the absence of any liquids (e.g., water). Unless otherwise specified, all percentages given herein for the solid materials, compounds, substances, etc., are on a solids basis.

For the purposes of the present invention, the term "solids content" refers to the percentage of non-volatile, non-liquid components (by weight) that are present in the composition, etc.

For the purposes of the present invention, the term "gsm" is used in the conventional sense of referring to grams per square meter.

For the purposes of the present invention, the term "mil(s)" is used in the conventional sense of referring to thousandths of an inch.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "room temperature" refers to the commonly accepted meaning of room temperature, i.e., an ambient temperature of 20° to 25° C.

For the purposes of the present invention, the term "optical brightness" refers to the diffuse reflectivity of the fluff pulp web/fibers, for example, at a mean wavelength of light of 457 nm. As used herein, optical brightness of fluff pulp webs may be measured in terms of ISO Brightness which measures brightness using, for example, an ELREPHO Datacolor 450 spectrophotometer, according to test method ISO 2470-1, using a C illuminant with UV included.

For the purposes of the present invention, the term "optical brightener agent (OBA)" refers to certain fluorescent materials which may increase the brightness (e.g., white appearance) of fluff pulp web surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). The use of OBAs is often for the purpose of compensating for a yellow tint or cast of paper pulps which have, for example, been bleached to moderate levels. This yellow tint or cast is produced by the absorption of short-wavelength light (violet-to-blue) by the fluff pulp webs. With the use of OBAs, this short-wavelength light that causes the yellow tint or cast is partially replaced, thus improving the brightness and whiteness of the fluff pulp web. OBAs are desirably optically colorless when present on the fluff pulp web surface, and do not absorb light in the visible part of the spectrum. These OBAs may be anionic, cationic, anionic (neutral), etc., and may include one or more of: stilbenes, such as 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc, See commonly assigned U.S. Pat. No. 7,381,300 (Skaggs et al.), issued Jun. 3, 2008, the entire contents and disclosure of which is herein incorporated by reference. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostilbene-2,2'-disulphonic acid (including salts thereof), and in particular the bistriazinyl derivatives (e.g., 4,4-bis(triazine-2-ylamino)stilbene-2,2'-disulphonic acid), the disodium salt of distyrlbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from Ciba Geigy under the trademark TINOPAL®, from Clariant under the trademark LEUCOPHOR®, from Lanxess under the trademark BLANKOPHOR®, and from 3V under the trademark OPTIBLANC®.

For the purpose of the present invention, the term "treating" with reference to the fire retardant compositions may include adding, depositing, applying, spraying, coating, daubing, spreading, wiping, dabbing, dipping, etc.

For the purposes of the present invention, the term "applicator" refers to a device, equipment, machine, etc., which may be used to treat, apply, coat, etc., one or more sides or surfaces of a fluff pulp web, air-laid fibrous structure, etc., with the fire retardant composition. Applicators may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., the fire retardant composition on a fluff pulp web, air-laid fibrous structure, etc. Metering size presses may include a rod metering size press, a gated roll metering size press, a doctor blade metering size press, etc.

For the purposes of the present invention, the term "rod metering size press" refers to metering size press that uses a rod to spread, meter, etc., the fire retardant composition on a fluff pulp web, air-laid fibrous structure, etc. The rod may be stationary or movable relative to the web.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the web, may rotate relative to the web, etc.

For the purposes of the present invention, the term "doctor blade metering size press" refers to a metering press which may use a doctor blade to spread, meter, etc., the fire retardant composition on a fluff pulp web, air-laid fibrous structure, etc.

Description

Embodiments of the fire resistant fluff pulp web of the present invention may comprise: a fluff pulp web comprising above about 45% (for example, above about 50%, such as above about 75% and including 100%) unrefined softwood fibers; a fire retardant present in and/or on the fluff pulp web in an amount of up to about 150 lbs fire retardant component per ton of the fluff pulp web (for example, in the range of from about 55 to about 90 lbs fire retardant component per ton, such as from about 60 to about 70 lbs fire retardant component per ton, of the fluff pulp web); and one or more fire retardant distributing surfactants which distribute the fire retardant in and/or on the fluff pulp web; wherein the fire retardant is in an amount and is distributed in and/or on the fluff pulp web in a manner so that the fire resistant fluff pulp web passes one or more of the following tests: the UL 94 TMVB test, or the Horizontal Burn Through test. The fluff pulp web has: a basis weight above about 40 (for example, above about 135 gsm, such as above about 200 gsm); a caliper of at least about 30 mils (for example, in the range of from about 30 to about 85 mils, such as from about 45 to about 65 mils); a fiberization energy of less than about 170 kJ/kg (e.g., less than about 160 kJ/kg); a moisture content of less than about 16% (for example, less than about 12%, such as about 7% or less); optionally a basis weight variability of less than about 5% (e.g., less than about 2.5%); optionally an optical brightness of greater than about 65 (for example, greater than about 75, such as at least about 84); optionally in roll form with a roll width of greater than about 9.5 inches; optionally a roll diameter of greater than about 40 inches. The fire retardant component may comprise from about 50 to about 98.5% by weight (e.g., from about 50 to about 95 by weight) of one or more fire retardants and from about 1.5 to about 50% by weight (e.g., from about 5 to about 50% by weight) of one or more organic amine fire retardant dispersants. In one embodiment, the fire retardant may comprise: from about 50 to 100% (e.g., from about 50 to about 95%) by weight of the total fire retardant of one or more phosphorous fire retardants; from 0 to about 10% (e.g., from about 1 to about 10%) by weight of the total fire retardant of one or more halogenated organic fire retardants; and from 0 to about 10% (e.g., from about 4 to about 10%) by weight of the total fire retardant of one or more metal oxide fire retardants.

Embodiments of the process of the present invention for providing fire resistant fluff pulp webs may comprise the following steps: (1) providing a fluff pulp web comprising above about 45% unrefined softwood fibers; and (2) treating with the fluff pulp web with the fire retardant component in an amount up to about 150 lbs fire retardant component per ton, such as in the range of from about 55 to about 90 lbs fire retardant component per ton (e.g., from about 60 to about 70 lbs fire retardant component per ton) of the fluff pulp web in the presence of one or more fire retardant distributing surfactants which distribute the fire retardant in and/or on the fluff pulp web in a manner so that the treated fluff pulp web provides a fire resistant fluff pulp web which passes one or more of the following tests: the UL 94 TMVB test, or the Horizontal Burn Through test.

Embodiments of fire resistant fluff pulp webs or fibers may be used in air-laid fibrous structures which may comprise: an air-laid fibrous core having an upper surface and a lower surface; a first fire resistant outer layer positioned over the upper surface; and a second fire resistant outer layer positioned under the lower surface. The air-laid fibrous core may comprise: from about 50 to about 97% (e.g., from about 80 to about 95%) by weight of the core of comminuted fluff pulp fibers; and from about 3 to about 50% (e.g., from about 5 to about 20%) by weight of the core of bicomponent fibers. Each of the upper and lower outer layers may comprise: from about 50 to about 95% (e.g., from about 80 to about 95%) by weight of the core of comminuted fire resistant fluff pulp fibers according to embodiments of the present invention; and from about 5 to about 50% (e.g., from about 5 to about 20%) by weight of the core of bicomponent fibers, and may comprise the same proportions by weight of fire resistant fluff pulp fibers and bicomponent fibers, or may comprise different proportions by weight of fire resistant fluff pulp fibers and bicomponent fibers. These outer layers may also optionally comprise up to about 20% (for example, up to about 10%, such as up to about 3%) by weight of the outer layer of melamine fibers or melamine resin powder to increase the fire resistant properties of these outer layers. These outer layers may also be treated with additional fire retardant in amounts of up to about 5% (for example, up to about 3%, such as up to about 2%) by weight of the outer layer to further increase the fire resistance of the outer layer. This additional fire retardant may be the same or a may be different from the fire retardant used to treat the fluff pulp web to provide the fire resistant fluff pulp web. Embodiments of these fire retardant air-laid structures (e.g., cores and associated outer layers) to be used, for example, in upholstery cushions, mattress ticking, panel fabric, padding, bedding, insulation, materials for parts in devices and appliances, etc.

The use the fire retardant distributing surfactant (for example, in a weight ratio to the fire retardant component of from about 1:5 to about 1:40, such as from about 1:10 to about 1:20) permits the fire retardant composition to be efficiently, effectively, homogenously, etc., distributed on and/or throughout the fluff pulp web when treated with the fire retardant composition. For example, an ethoxylated alcohol surfactant (such as F60 from Eka Chemical) may be used the fire retardant distributing surfactant in treating a fluff pulp sheet with an endothermic fire retardant mixture (e.g., a blend of ammonium phosphate, halogenated alkanes, antimony trioxide, and $C_{12}$-$C_{18}$ carbon chain length quaternary and/or linear amine dispersant surfactant(s)) which ensures efficient and homogeneous dispersion and/or distribution of the fire retardant mixture in and/or on the fluff sheet (and may increase the reactivity of the fire retardant cellulosic fluff pulp fibers) so as to reduce the amount of the fire retardant mixture required to achieve satisfactory fire resistance (e.g., from about 360 lbs fire retardant/ton of fluff pulp fiber to as low as about 55 lbs. fire retardant/ton of fluff pulp fiber), especially when treating the outer fire resistant fluff pulp layers used in air-laid fibrous structures with additional fire retardant composition. The fire retardant distributing surfactant may be incorporated as a component of the fire retardant composition prior to treating the fluff pulp web or may added separately but simultaneously or sequentially with the fire retardant composition when treating the fluff pulp web.

The components of the fire retardant, for example, the phosphorous fire retardant (e.g., ammonium phosphates) may function by crosslinking, for example, with the cellulosic fibers, by, for example, undergoing heat-induced crosslinking, for example, from heat generated during drying of the fluff pulp web after treatment with the fire retardant composition. The use of such crosslinking fire retardants which can crosslink with the cellulosic fluff pulp fibers (e.g., heat-induced "curing") during, for example, drying of the fluff pulp web after treatment with the fire retardant composition may also reduce the amount additional fire retardant composition that is needed to further treat the fluff pulp web after drying to insure adequate/acceptable fire resistance.

The fire retardant composition may be applied to the fluff pulp web in a variety places prior to drying to the fluff pulp web. For example, the fire retardant composition may be applied by a papermaking size press, a paper coater, a sprayer, a dispenser, a douser, etc. The incorporation, addition, etc., of trivalent metal cations (e.g., aluminum such as in the form of, for example, alum) in and/or on the fluff pulp web (e.g., in the blend chest or at least prior to the headbox which deposits the fluff pulp furnish on the forming wire) prior to treatment with the fire retardant composition, with or without debonder surfactant, may also enable the fire retardant composition to be distributed and dispersed more thoroughly, homogeneously, etc., and may also aid, assist, etc., in having the components in the fire retardant crosslink, bond, cure, etc., more effectively to the cellulosic fibers in the fluff pulp web.

In embodiments of the fire resistant fluff pulp webs of the present invention, the fluff pulp may comprise a variety of cellulosic fibrous materials derived from softwood fibers and/or hardwood fibers, including bleached or unbleached fluff pulp fibers, as well as recycled fluff pulp fibers, provided that the fluff pulp comprises above about 45% unrefined softwood fibers (e.g., above about 75% unrefined softwood fibers). See, for example, U.S. Pat. Appln. No. 20080050565 (Gross et al.), published Feb. 28, 2008, the entire contents and disclosure of which is herein incorporated by reference. The fluff pulps may be treated or untreated, and may optionally contain one or more than one additives, or combination thereof, known in the fluff pulp art. Cellulosic fibers for fluff pulps may be obtained by any pulping process, for example, chemical, mechanical, thermomechanical (TMP), and/or chemithermomechanical pulping (CTMP) processes, which may include digestion, refining, and/or bleaching operations. In some embodiments, at least a portion of the fluff pulp fibers may be obtained from non-woody herbaceous plants including, but not limited to, kenaf, hemp, jute, flax, sisal, abaca, etc.

The fluff pulp web may be prepared from the fluff pulp by any suitable process for providing fluff pulp webs. For example, the fluff pulp web may be formed from a fluff pulp mixture into a single or multi-ply web on a papermaking machine such as a Fourdrinier machine or any other suitable papermaking machine known in the art for making fluff pulp webs. See, for example, U.S. Pat. No. 4,065,347 (Aberg et al.), issued Dec. 27, 1997; U.S. Pat. No. 4,081,316 (Aberg et al.), issued Mar. 28, 1978; U.S. Pat. No. 5,262,005 (Ericksson et al.), issued Nov. 16, 1993, the entire contents and disclosure of which are herein incorporated by reference. The fluff pulp mixture may also be treated with one or more debonder surfactants (as described above) to make the process of comminuting such pulp webs (e.g., for providing air-laid fibrous structures) easier to carry out. The resulting fluff pulp web which is formed may be dried to remove a portion, most or all of the water from the web, with the dried web being optionally treated with one or more additional debonder surfactants to again enhance the process of comminuting such fluff pulp webs.

An embodiment of a process for preparing fluff pulp webs may comprise the following steps: (a) forming a first mixture by contacting at least one cationic trivalent metal, salt thereof, or combination thereof with a composition comprising fluff pulp fibers and water at a first pH; (b) forming a fluff pulp mixture by contacting at least one debonder surfactant with the first mixture of step (a) and raising the pH to a second pH which is higher than the first pH; (c) forming a fluff pulp web from the fluff pulp mixture of step (b); and (d) drying the fluff pulp web of step (c). In an embodiment, step (a) may be carried out by performing one or more of the following steps: (i) contacting the fluff pulp mixture with a table in a papermaking machine; and/or (ii) removing at least a portion of water from the fluff pulp mixture with a suction box under a table in a papermaking machine. In some embodiments, the first pH may be less than about 5.0 (which may include any value or subrange, for example, any value or subrange including 1, 2, 2.5, 3, 3.1, 3.2, 3.3, 3.4, 3.5, 3.6, 3.7, 3.8, 3.9, 4, 4.1, 4.2, 4.3, 4.4, 4.5, 4.6, 4.7, 4.8, 4.9, etc.). In some embodiments, the second pH may be about 5.0 or greater (may include any value or subrange, for example, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7, 8, 9, 10, 11, etc.).

In some embodiments, the fluff pulp webs may be treated with a first debonder surfactant. For example, the first debonder surfactant may be sprayed onto the fluff pulp web, such as by using a formation shower or spray boom over the table, coated onto the web using known coating methods in the papermaking arts, immersing the web in the debonder surfactant, etc., as well as any combination of treatment methods. In one embodiment, the first mixture may be contacted with the first debonder surfactant before, during, or after the raising of the pH to the second pH during step (b), or any combination thereof. The pH may be suitably raised, for example, by adding one or more known pH adjusters to the first mixture before, during, or after contacting the first mixture with the first debonder surfactant. Optionally, the pH may be further adjusted by adding one or more pH adjusters to the fluff pulp web using a formation shower, spray boom, etc., or a combination thereof. The fluff pulp web may also be treated with additional debonder surfactants (e.g., a second or third debonder surfactant) which may be the same or different from the first debonder surfactant, and may use the same or different treatment method(s). In some embodiments, the fluff pulp web is treated with a third debonder surfactant after the final drying of the web, as described below. In some embodiments, the debonder surfactant(s) may be used neat or as purchased, may be used in a solution, dispersion, emulsion, etc., at concentrations in the range of from about 1 to about 50% by weight of solids (which includes any value and subrange, for example, values or subranges including about 0.5, 1, 2, 3, 4, 5, 6, 7, 8, 9, 10, 11, 12, 13, 14, 15, 16, 17, 18, 19, 20, 25, 30, 35, 40, 45, 50%, etc.). In some embodiments, the debonder surfactant(s) may be in the form of a composition further comprising water and optionally one or more of: a pH adjusting agent, whitener, colorant, pigment, optical brightening agent, wetting agent, binder, bleaching agent, trivalent metal, etc. The additive may be present in amounts in the range of from about 0.005 to about 50 weight percent based on the weight of the debonder surfactant composition (which includes any value and subrange, for example, values or subranges including about 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, 50 weight percent, etc., based on the weight of the debonder surfactant composition). The method of contacting the fluff pulp fibers with the debonder surfactant, as well as the amount, composition, temperature, residence time, etc., may be varied as needed. For example, if desired, the total amount of debonder surfactant in the fluff pulp mixture, web and/or in the finished fluff pulp sheet may be optionally increased or decreased or otherwise controlled by controlling the various points of addition. For example, the amount of debonder surfactant use in the first mixture at the wet end may be optionally increased or decreased by respectively decreasing or increasing any amount used, if desired, at the web, the dry end, or both.

In some embodiments, the first mixture of step (a) further comprises one or more additive such as whitener, colorant, pigment, optical brightening agent, wetting agent, binder, bleaching agent, other additive, etc. The additive may be present in amounts in the range of from about 0.005 to about 50 weight percent based on the weight of the first mixture (which may include any value or subrange, for example, any value or subrange including about 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, 50 weight percent, etc., based on the weight of the first mixture).

In some embodiments, the fluff pulp web may be dried in a drying section. Any suitable method for drying fluff pulp webs known in the fluff pulp making art may be used. The drying section may include a drying can, flotation dryer, cylinder drying, Condebelt drying, infrared (IR) drying, etc. The fluff pulp web may be dried so as to contain any selected amount of water/moisture. For example, the fluff pulp web may be dried to a moisture content of between 0 and less than about 16% (which includes any value and subrange, for example, values or subranges including 0, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15%, etc.). In one embodiment, the fluff pulp web may be dried to a moisture content of less than about 12%. In other embodiments, the fluff pulp web may be dried to a moisture content of about 7% or less, for example, a moisture content of about 6.3% or less.

In some embodiments, the fluff pulp web may have a basis weight in the range of from above about 40 to about 1100 gsm (which includes any value and subrange, for example, values or subranges including about 45, 55, 65, 75, 85, 95, 100, 125, 135, 150, 175, 200, 225, 250, 275, 300, 325, 350, 400, 500, 600, 700, 800, 900, 1000, 1100 gsm, etc.). In some embodiments, the fluff pulp web may have a density in the range of from about 0.5 to about 0.75 g/cc (which includes any value and subrange, for example, values or subranges including about 0.5, 0.55, 0.6, 0.65, 0.7, and 0.75 g/cc, etc.). In some embodiments, the fluff pulp web may have a caliper of at least about 30 mils, for example in the range of from about 30 to about 85 mils, such as from about 45 to about 65 miles (which includes any value and subrange, for example, values or subranges including about 30, 35, 40, 45, 50, 55, 65, 70, 75, 80, 85 mils, etc.). In some embodiments, the fluff pulp web may have a fiberization (shred) energy of less than about 170 kJ/kg (which includes any value and subrange, for example, values or subranges including about 1, 2, 3, 4, 5, 6, 7, 8, 9, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165 kJ/kg, etc.). In other embodiments, the web may have a fiberization energy in the range of from about 120 to less than about 145 kJ/kg, in the range of from about 100 to less than about 120 kJ/kg. In one embodiment, the fluff pulp web may have a fiberization energy of less than about 135 kJ/kg for example, a fiberization energy of less than about 120 kJ/kg, such as less than about 100 kJ/kg, or less than about 90 kJ/kg. In other embodiments, the web may have a fiberization energy in the range of from about 120 to less than about 145 kJ/kg, in the range of from about 100 to less than about 120 kJ/kg.

In some embodiments, the fluff pulp web comprises the debonder surfactant in an amount of about 1 lb solids or greater per ton of the fluff pulp fibers (which includes any value and subrange, for example, values or subranges including about 1, 1.1, 1.2, 1.3, 1.4, 1.5, 1.6, 1.7, 1.8, 1.9, 2, 2.0, 2.1, 2.2, 2.3, 2.4, 2.5, 2.6, 2.7, 2.8, 2.9, 3, 3.0, 3.1, 3.2, 3.3, 3.4, 3.5, 3.6, 3.7, 3.8, 3.9, 4, 4.0, 5, 5.0, 6, 7, 8, 9, 10, 15, 20 lbs solids debonder surfactant per ton of the fluff pulp fibers, etc., or higher). In some embodiments, the fluff pulp web comprises the trivalent metal (or salt thereof) in an amount of about 1 lb solids or greater per ton of the fluff pulp fibers (which includes any value and subrange, for example, values or subranges including about 1, 1.1, 1.2, 1.3, 1.4, 1.5, 1.6, 1.7, 1.8, 1.9, 2, 2.0, 2.1, 2.2, 2.3, 2.4, 2.5, 2.6, 2.7, 2.8, 2.9, 3, 3.0, 3.1, 3.2, 3.3, 3.4, 3.5, 3.6, 3.7, 3.8, 3.9, 4, 4.0, 5, 5.0, 6, 7, 8, 9, 10, 15, 20, 25, 30, 35 lbs cationic trivalent metal/salt thereof, etc., or higher). In some embodiments, the fluff pulp web comprises the trivalent metal in an amount of about 150 ppm or greater per ton of the fluff pulp fibers (which includes any value and subrange, for example, values or subranges including about 150, 155, 160, 165, 170, 175, 180, 185, 190, 195, 200, 205, 210, 215, 220, 225, 230, 235, 240, 245, 250, 300, 330, 400, 450, 500, 550, 750, 1000 ppm, etc., or higher).

In some embodiments of the present invention, the fluff pulp web may comprise from above about 75 to 100 wt % fluff pulp fibers based upon the total weight of the fluff pulp. In one embodiment, the fluff pulp web may comprise from about 95 to 100 wt % fluff pulp fibers derived from softwood species based upon the total amount of fluff pulp fibers in the fluff pulp web (which includes any value and subrange, for example, values or subranges including about 76, 80, 85, 90, 95, and 100 wt %, based upon the total amount of fluff pulp fibers in the fluff pulp web, etc.). All or part of the softwood fibers may be optionally derived from softwood species having a Canadian Standard Freeness (CSF) of from 300 to 750. In one embodiment, the fluff pulp web may contain fluff pulp fibers from a softwood species having a CSF from about 400 to about 550 (which includes any value and subrange, for example, values or subranges including about 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750 CSF, etc.). Canadian Standard Freeness (CSF) may be measured by TAPPI T-227 standard test.

In some embodiments, the fluff pulp web may optionally comprise up to about 25 wt % fluff pulp fibers derived from hardwood species based upon the total amount of fluff pulp fibers in the fluff pulp web. In one embodiment, the fluff pulp web may comprise from 0 to about 15 wt % fluff pulp fibers derived from hardwood species based upon the total amount of fluff pulp fibers in the fluff pulp web (which includes any value and subrange, for example, values or subranges including about 1, 2, 5, 10, 15, 20, 25 wt %, etc., based upon the total amount of fluff pulp fibers in the fluff pulp web). All or part of the hardwood fibers may be optionally derived from softwood species having a Canadian Standard Freeness (CSF) of from 300 to 750. In one embodiment, the fluff pulp sheet contains fluff pulp fibers from a softwood species having a CSF from about 400 to about 550 (which includes any value and subrange, for example, values or subranges including about 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750 CSF, etc.). Canadian Standard Freeness (CSF) may be measured by TAPPI T-227 standard test Embodiments of the fire resistant fluff pulp web of the present invention may be used, for example, to provide air-laid fibrous structures, including air-laid fibrous cores, air-laid fibrous layers (including outer layers for air-laid fibrous cores), etc. See, for example, U.S. Pat. Appln. No. 20080050565 (Gross et al.), published Feb. 28, 2008; U.S. Pat. No. 6,059,924 (Hoskins), issued May 9, 2000); U.S. Pat. No. 7,549,853 (Fegelman et al.), issued Jun. 23, 2009, the entire disclosure and contents of which are herein incorporated by reference. The fire resistant fluff pulp webs may be comminuted (e.g., defiberized, disintegrated, shredded, fragmented, etc.) to provide such air-laid fibrous structures using known methods for making such structures. See, for example, U.S. Pat. No. 3,591,450 (Murphy et al.), issued Jul. 6, 1971, the entire contents and disclosure of which is herein incorporated by reference. For example, the fire resistant fluff pulp webs may be defiberized, disintegrated, shredded, fragmented, etc., by using a hammermill. In one embodiment, hammer milling is carried out in a manner which does not induce significant dust creation in the comminuted fire resistant fluff pulp fibers. The resultant air-laid fibrous structure may be used in a variety of products, for example, upholstery cushions, mattress ticking, panel fabric, padding, bedding, insulation, materials for parts in devices and appliances, etc.

In some embodiments, the air-laid fibrous structures may comprise a mixture, blend, etc., of comminuted fire resistant fluff pulp fibers and synthetic fibers (e.g., bicomponent fibers). For example, the air-laid fibrous structure may be in the form of an air-laid fibrous core which comprises a mixture, blend, etc., of comminuted fire resistant fluff pulp fibers and synthetic fibers (e.g., bicomponent fibers). For example, these structures may comprise about 50% or greater (for example, about 75% or greater) by weight fire resistant fluff pulp fiber, about 50% or less (for example, about 15% or less) synthetic fiber (e.g., bicomponent fiber), and optionally up to about 20% (e.g., from about 3 to about 10%) melamine fiber/powder. (Air-laid fibrous structures without melamine fiber may pass the UL 94 TMVB test when those structures comprise, for example, about 90% fire resistant fluff pulp fiber and about 10% bicomponent fiber, and are sprayed with about 3% fire retardant on the surface of the outer layers of such structures.)

Embodiments of the air-laid fibrous structures may be prepared by comminuting (e.g., disintegrating, defibrizing, etc.) a fluff pulp web (e.g., a fluff pulp sheet), for example, by using a hammermill (such as a Kamas Hammermill), to provide individualized comminuted fluff pulp fibers. The comminuted fluff pulp fibers may then be air conveyed to forming heads on an air-laid web-forming machine. A number of manufacturers provide air-laid web forming machines suitable for use in embodiments of the air-laid fibrous structures of the present invention, including Dan-Web Forming of Aarhus, Denmark, M&J Fibretech A/S of Horsens, Denmark, Rando Machine Corporation of Macedon, N.Y. (for example, as described in U.S. Pat. No. 3,972,092 to Wood, issued Aug. 3, 1976, the entire contents and disclosure of which is herein incorporated by reference), Margasa Textile Machinery of Cerdanyola del Valles, Spain, and DOA International of Wels, Austria. While these various forming machines may differ in how the comminuted fluff pulp fiber is opened and air-conveyed to the forming wire, all of these machines are capable of producing webs useful for forming embodiments of air-laid fibrous structures.

The Dan-Web forming heads may include rotating or agitated perforated drums, which serve to maintain fiber separation until the fibers are pulled by vacuum onto a foraminous forming conveyor, forming wire, etc. In the M&J machine, the forming head may basically be a rotary agitator above a screen. The rotary agitator may comprise a series or cluster of rotating propellers or fan blades. Synthetic fibers (e.g., bicomponent fibers) may also be opened, weighed, and mixed in a fiber dosing system such as a textile feeder supplied by Laroche S.A. of Cours-La Ville, France. From the textile feeder, the synthetic fibers may be air conveyed to the forming heads of the air-laid machine where those synthetic fibers are further mixed with the comminuted fluff pulp fibers from the hammermill(s) and may be deposited on a continuously moving forming wire. For providing defined air-laid fibrous layers, separate forming heads may be used for each type of fiber.

The air-laid fibrous web may be transferred from the forming wire to a calender or other densification stage to densify the air-laid fibrous web, if necessary, to increase its strength and to control web thickness. The fibers of the air-laid fibrous web may then be bonded by passage through an oven set to a temperature high enough to fuse any included thermoplastic synthetic fibers or other binder materials. Secondary binding from the drying or curing of a latex spray or foam application may also occur in the same oven. The oven may be a conventional through-air oven or may be operated as a convection oven, but may also achieve the necessary heating by infrared or even microwave irradiation.

Embodiments the process of the present invention for providing fire resistant fluff pulp webs are further illustrated in FIG. 1. FIG. 1 is a schematic diagram which shows an illustrative process for providing a fire resistant fluff pulp web according to an embodiment of the present invention, which is indicated generally as 100. In process 100, the fluff pulp fibers may be combined, blended together, etc., in a Blend Chest, indicated generally as 104, to provide a fluff pulp mixture. For example, in one embodiment, softwood and hardwood fibers may be mixed together in Blend Chest 104. The fluff pulp mixture from Blend Chest 104 (and any other optional additives such as fluff pulp binders, fluff pulp pigments, mixing/web penetration aids, etc.) may then be transferred, pumped, etc., as indicated by arrow 108, to a Headbox, indicated as 112. A furnish of fluff pulp fibers is then deposited from Headbox 112, as indicated by arrow 116, onto a forming wire, forming table, forming screen, forming fabric, etc., such as a Fourdrinier forming wire, indicated as 120, to provide a fluff pulp web, indicated generally as 124.

Web 124 may then pass through a Press Section (e.g., comprising heavy rotating cylinders), indicated generally as 128, to remove some of the water/moisture from web 124, to compact or densify web 124, increase solids present in web 124 (e.g., to from about 30% solids to about 48% solids by removing water), etc. After leaving Press Section 128, web 124 may then pass through a first Dryer Section, indicated generally as 132, to further reduce the moisture content of web 124 (e.g., to less than about 25%), etc. Dryer Section 132 may comprise, for example, dryer cans, direct gas-fired caps, an infrared (IR) dryer, etc. After leaving Dryer Section 132, dried web 124 may then pass through a Size Press, indicated generally as 136, to treat dried web 124 with a fire retardant composition, as well as to treat dried web 124 with any other optional additives. See, for example, FIGS. 2-4 and corresponding description below, for treating web 124 with a fire retardant composition using a Size Press 136. In an embodiment, the one or more fire retardants may be mixed together with the fire retardant distributing surfactant to form the fire retardant composition which is then applied to web 124 by Size Press 136. In another embodiment, the fire retardant distributing surfactant is added separately from the fire retardant composition to web 124 at Size Press 136. In another embodiment, Size Press 136 may comprise a puddle size press to increase the exposure time of web 124 to the fire retardant composition.

After leaving Size Press 136, fire retardant treated web 124 may then pass through a second Dryer Section, indicated generally as 140, to further reduce the moisture content of web 124 (e.g., to increase the solids content of web 124 to above about 88%), as well as to crosslink, cure, etc., the fire retardant present on and through web 124. For example, Dryer Section 140 may comprise any of the dryer mechanisms described above for Dryer Section 132 to provide a temperature high enough to crosslink/cure the fire retardant on/in web 124. After leaving second Dryer Section 140, dried and cured web 124 may then be taken up in the form of, for example, a roll of fire retardant-treated fire resistant fluff pulp web, indicated generally as 144. Roll 144 may be cut into smaller length and/or width portions (e.g., sheets, rolls, etc.) for sale, distribution, further treatment with other additives, etc.

While FIG. 1 shows process 100 as treating web 124 with the fire retardant composition at Size Press 136, web 124 may also be treated at any other point in process 100 which is prior to first Dryer Section 132 (or if other processing sections are used in place of Size Press 136, prior to second Dryer Section 140). For example, instead of treating web 124 with fire retardant composition at Size Press 136, the fire retardant composition, along with the fire retardant distributing surfactant may be added to web 124 at forming wire 120 by using, for example, a spray boom. The placement of the spray boom may be such that the fire retardant composition/surfactant is pulled through the entire web 124 without significant excess being removed into, for example, a "white water system" which may be recycled for further use in process 100. In some embodiments, this recycled water stream may be used to supply at least a portion of the fire retardant composition applied at Size Press 136 (this recycled water stream may contain some residual fire retardant chemicals) to increase fire retardant chemical use efficiency and to minimize fire retardant chemical loss. The fire retardant composition may be applied to web 124 prior to Dryer Section 132 (i.e., omitting Size Press 136 and second Dryer Section 140) with subsequent crosslinking/curing of the fire retardant on/in web 124.

Figure 2:
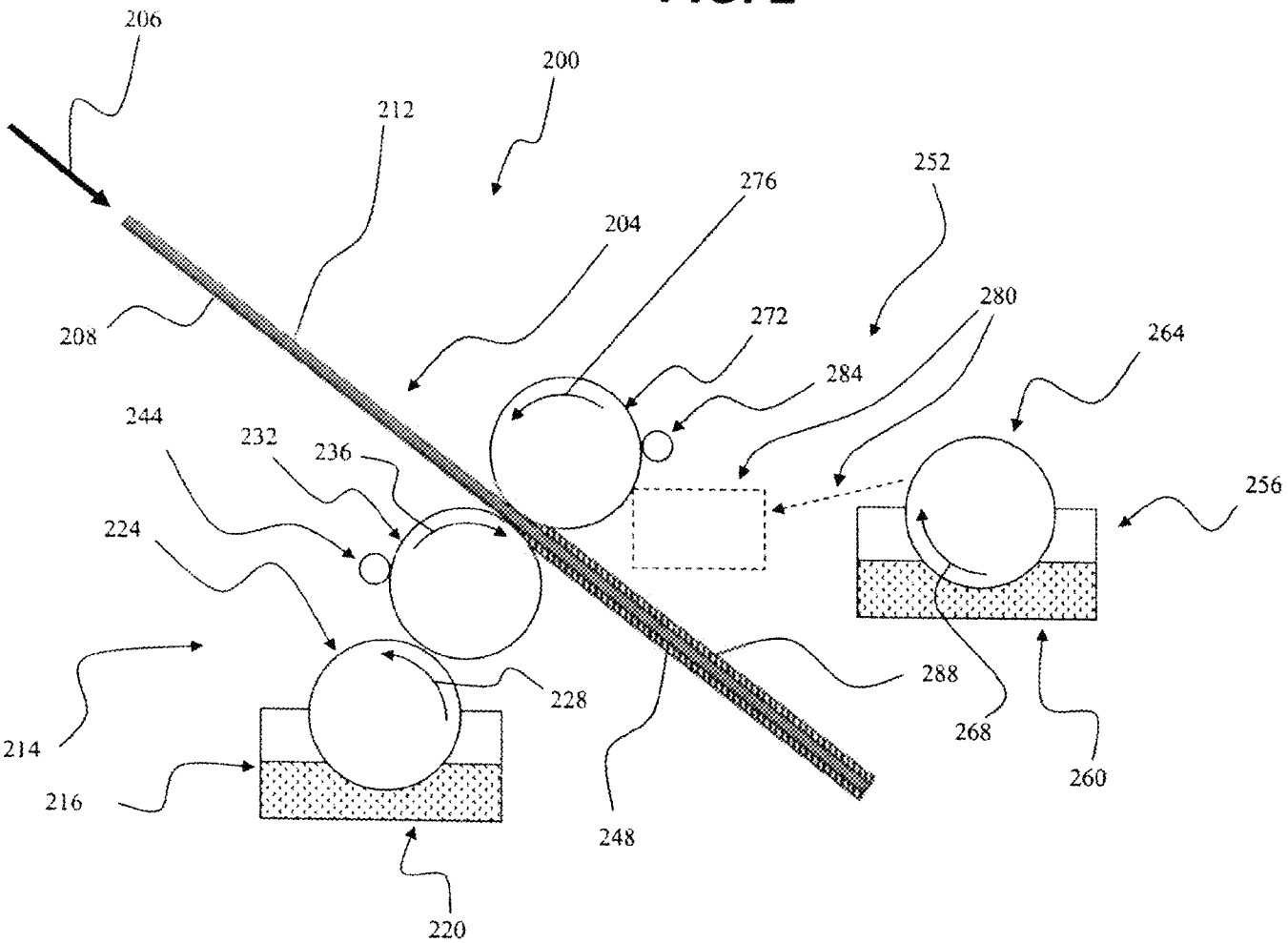
FIG. 2 a schematic diagram illustrating an embodiment of a process for treating one or both surfaces of a fluff pulp web with a fire retardant composition using a metering rod size press.

An embodiment of a process of the present invention for treating one or both surfaces of the fluff pulp web with a fire retardant composition is further illustrated in FIG. 2. Referring to FIG. 2, an embodiment of a system for carrying out an embodiment of the process of the present invention is illustrated which may be in the form of, for example a rod metering size press indicated generally as 200. Size press 200 may be used to coat a fluff pulp web, indicated generally as 204. Web 204 moves in the direction indicated by arrow 206, and which has a pair of opposed sides or surfaces, indicated, respectively, as 208 and 212.

Size press 200 includes a first assembly, indicated generally as 214, for applying the fire retardant composition to surface 208. Assembly 214 includes a first reservoir, indicated generally as 216, provided with a supply of a fire retardant composition, indicated generally as 220. A first take up roll, indicated generally as 224 which may rotate in a counterclockwise direction, as indicated by curved arrow 228, picks up an amount of the fire retardant composition from supply 220. This amount of fire retardant composition that is picked up by rotating roll 224 may then be transferred to a first applicator roll, indicated generally as 232, which rotates in the opposite and clockwise direction, as indicated by curved arrow 236. (The positioning of first take up roll 224 shown in FIG. 2 is simply illustrative and roll 224 may be positioned in various ways relative to first applicator roll 232 such that the fire retardant composition is transferred to the surface of applicator roll 232.) The amount of fire retardant composition that is transferred to first applicator roll 232 may be controlled by metering rod 244 which spreads the transferred composition on the surface of applicator roll 232, thus providing relatively uniform and consistent thickness of a first coating, indicated as 248, when applied onto the first surface 208 of web 204 by applicator roll 232.

As shown in FIG. 2, size press 200 may also be provided with a second assembly indicated generally as 252, for applying the fire retardant composition to surface 212. Assembly 252 includes a second reservoir indicated generally as 256, provided with a second supply of a fire retardant composition, indicated generally as 260. A second take up roll, indicated generally as 264 which may rotate in a clockwise direction, as indicated by curved arrow 268, picks up an amount of the fire retardant composition from supply 260. This amount of fire retardant composition that is picked up by rotating roll 264 may then be transferred to second take up roll, indicated generally as 272, which rotates in the opposite and counterclockwise direction, as indicated by curved arrow 276. As indicated in FIG. 2 by the dashed-line box and arrow 276, second take up roll 264 may be positioned in various ways relative to second applicator roll 272 such that the fire retardant composition is transferred to the surface of applicator roll 272. The amount of fire retardant composition that is transferred to second applicator roll 272 may be controlled by a second metering rod 284 which spreads the transferred composition on the surface of applicator roll 272, thus providing relatively uniform and consistent thickness of the second coating, indicated as 288, when applied onto the second surface 212 of web 204 by applicator roll 272.

Figure 3:
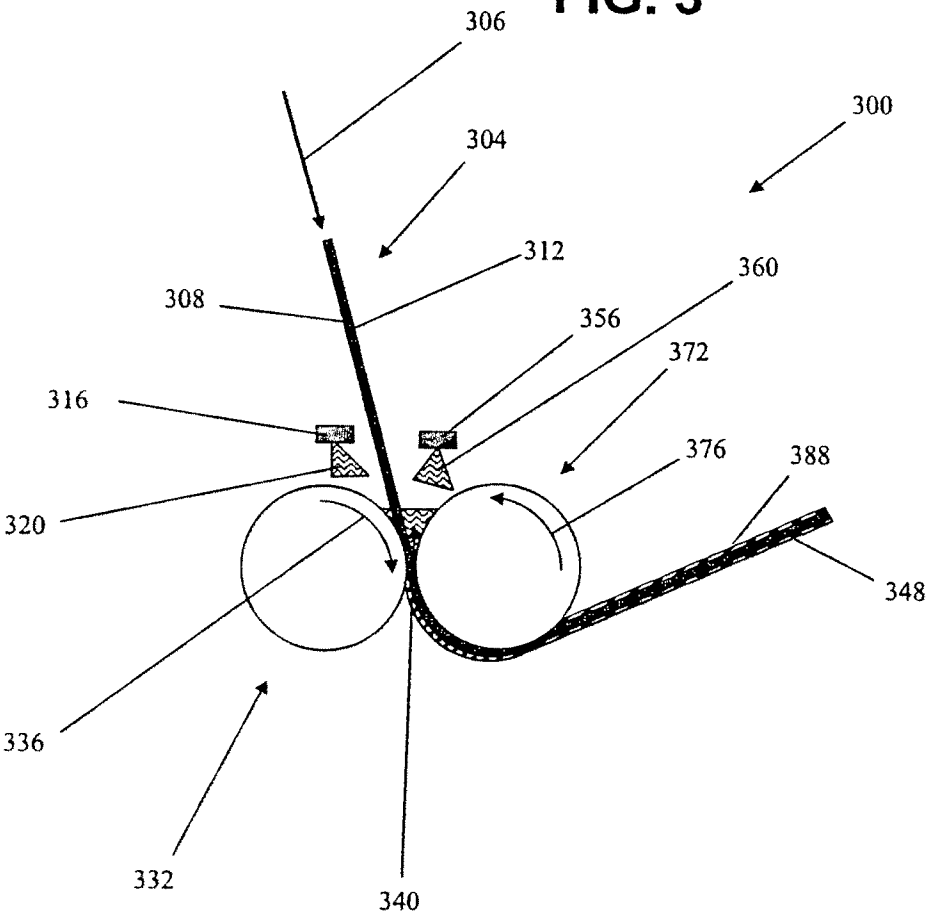
FIG. 3 a schematic diagram illustrating an embodiment of a process for treating one or both surfaces of a fluff pulp web with a fire retardant composition using a horizontal flooded nip size press.

Referring to FIG. 3, another embodiment of a system for carrying out an embodiment of the process of the present invention is illustrated which may be in the form of, for example, a horizontal flooded nip size press indicated generally as 300. Horizontal size press 300 may be used to coat a paper web, indicated generally as 304, with a fire retardant composition (e.g., as described in FIG. 2 above). Web 304 moves in the direction indicated by arrow 306, and has a pair of opposed sides or surfaces, indicated, respectively, as 308 and 312.

Horizontal size press 300 includes a first source of fire retardant composition, indicated generally as nozzle 316, which is sprays a stream of the fire retardant composition, indicated by 320, generally downwardly towards the surface of a first transfer roll, indicated as 332, which rotates in a clockwise direction, as indicated by curved arrow 336. A flooded pond or puddle, indicated generally as 340, is created at the nip between first transfer roll 332 and second transfer roll 372 due to a bar or dam (not shown) positioned at below the nip. Transfer roll 332 transfers a relatively uniform and consistent thickness of a first coating of the fire retardant composition, indicated as 348, onto the first surface 308 of web 304.

A second source of fire retardant composition, indicated generally as nozzle 356, which is sprays a stream of the fire retardant composition, indicated by 360, generally downwardly towards the surface of a second transfer roll, indicated as 372, which rotates in a counterclockwise direction, as indicated by curved arrow 376. Transfer roll 372 transfers a relatively uniform and consistent thickness of a second coating of the fire retardant composition, indicated as 388, onto the second surface 312 of web 304.

Figure 4:
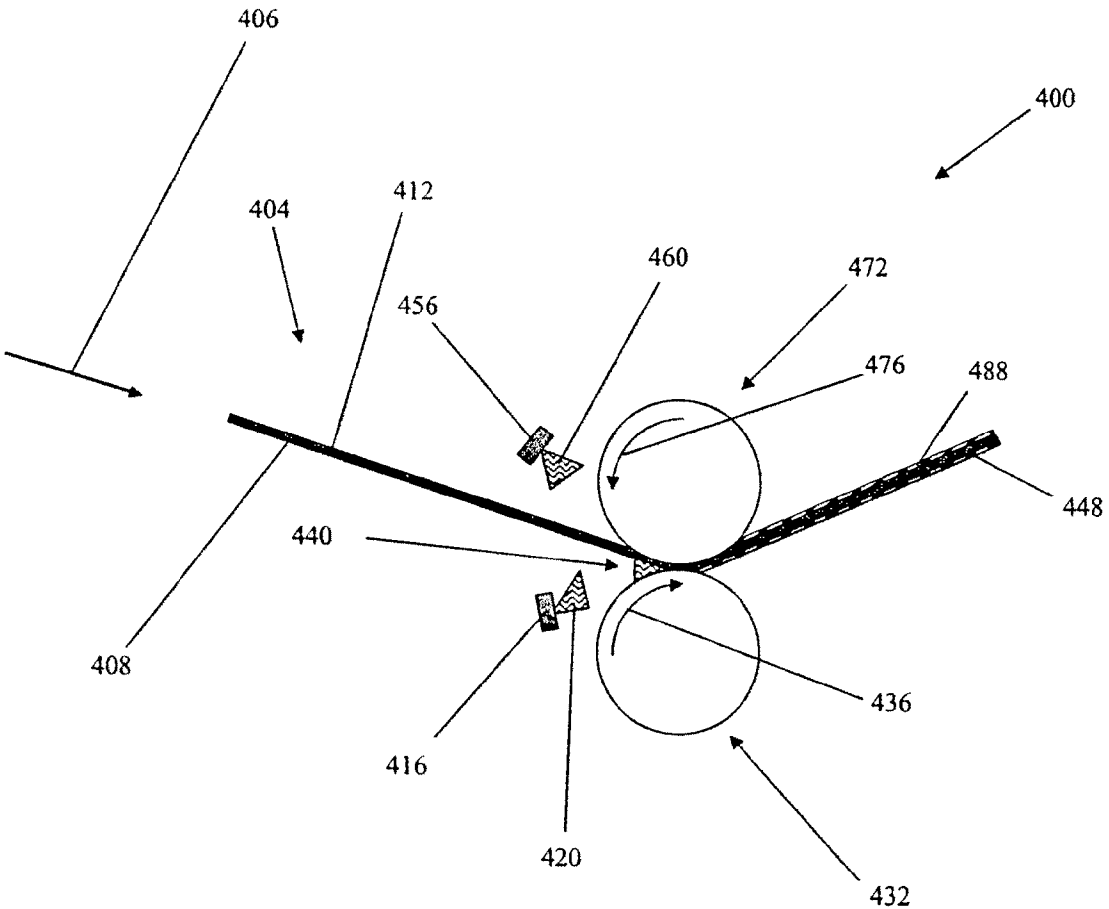
FIG. 4 a schematic diagram illustrating an embodiment of a process for treating one or both surfaces of a fluff pulp web with a fire retardant composition using a vertical flooded nip size press.

Referring to FIG. 4, another embodiment of a system for carrying out an embodiment of the process of the present invention is illustrated which may be in the form of, for example, a vertical flooded nip size press indicated generally as 400. Vertical size press 400 may be used to coat a paper web, indicated generally as 404, with a fire retardant composition (e.g., as described in FIG. 2 above). Web 404 moves in the direction indicated by arrow 406, and has a pair of opposed sides or surfaces, indicated, respectively, as 408 and 412.

Vertical size press 400 includes a first source of fire retardant composition, indicated generally as nozzle 416, which is sprays a stream of the fire retardant composition, indicated by 420, generally upwardly and towards the surface of a first lower transfer roll of the roll stack, indicated as 432, which rotates in a clockwise direction, as indicated by curved arrow 436. A smaller flooded pond or puddle, indicated generally as 440, (compared to the pond or puddle 440 of horizontal size press 400) is created at the nip between lower first transfer roll 432 and second upper transfer roll 472 due to a bar or dam (not shown) positioned to right of the nip. Transfer roll 432 transfers a relatively uniform and consistent thickness of a first coating of the fire retardant composition, indicated as 448, onto the lower first surface 408 of web 404.

A second source of fire retardant composition, indicated generally as nozzle 456, sprays a stream of the fire retardant composition, indicated by 460, generally downwardly and towards the surface of a second upper transfer roll, indicated as 472, which rotates in a counterclockwise direction, as indicated by curved arrow 476. Transfer roll 472 transfers a relatively uniform and consistent thickness of a second coating of the fire retardant composition, indicated as 488, onto the upper second surface 412 of web 404.

Figure 5:
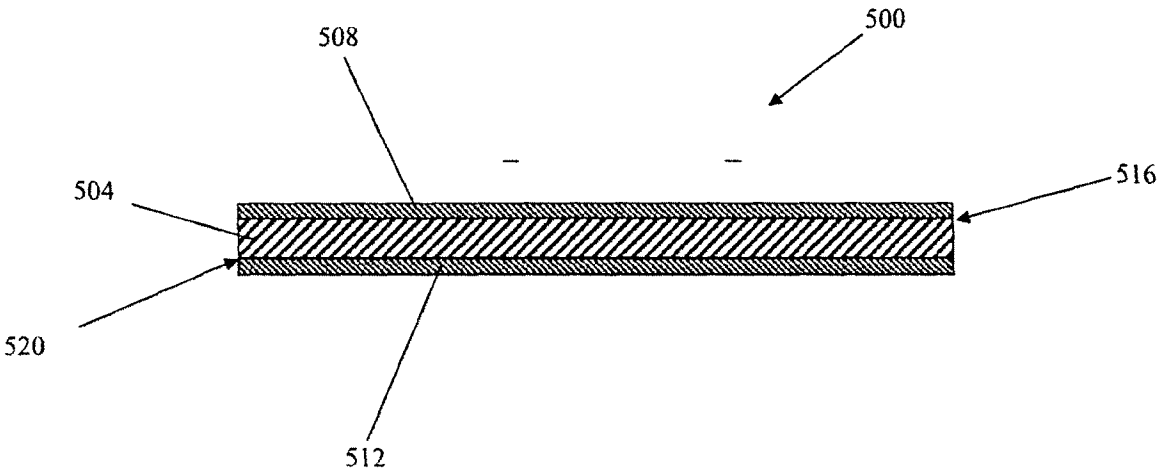
FIG. 5 is side sectional view of an air-laid fibrous structure which comprises a fire resistant fluff pulp web according to an embodiment of the present invention as the respective outer layers of the air-laid fibrous core of the structure.

FIG. 5 is side sectional view of an air-laid fibrous structure which comprises a fire resistant fluff pulp web according to an embodiment of the present invention as the respective outer layers of the air-laid fibrous core of the structure, which is indicated generally as 500. Structure 500 comprises an air-laid fibrous core, indicated generally as 504, and two outer fire retardant outer air-laid fibrous layers, indicated respectively as upper layer 508 and lower layer 512. Upper outer layer 508 is positioned on or adjacent upper surface 516 of core 504, while lower outer layer 512 is positioned on or adjacent lower surface 520 of core 504. Outer layers 508 and/or 512 of structure 500 may be treated with additional fire retardant (for example, the additional fire retardant may be diluted with water and/or other solvent(s), with the water/solvent(s) being removed, for example, by heating after treatment).

Fire Resistant Test Specimen Preparation

The specimens for the fire resistance tests are prepared as follows: Fire retardant-treated fluff pulp sheets are defiberized in a lab hammermill (Kamas Type H 01 Laboratory Defribrator) by shredding 2 inch width strips at 3300 rpm using a 10 mm screen opening and 7 cm/sec. feed speed. The defiberized fluff pulp fibers are mixed in the plastic bag by hand and by vigorously shaking the sealed bag which contains air space, to achieve as uniform a distribution of fiber fractions as possible, i.e., to achieve a representative test specimen. Approximately 3.4 g of the mixed fluff pulp fibers are weighed out to provide a target weight of 3.16 g±0.1 g (300 g/m$^2$). A piece of the nonwoven barrier material is inserted into a collection basket/cup of a 11 cm diameter forming funnel which is attached in the hammermill. The weighed fluff pulp fibers are refiberized in the hammermill using the front chute with a rotor setting at ~750 rpm and with a 14 mm screen in place. With the forming funnel removed from the hammermill, the refiberized fluff pulp in the funnel is evenly spaced using long handle tweezers, and then pressed firmly into the funnel with a tamping tool. The resultant specimen is then removed and weighed. The weighed specimen is then placed without the nonwoven barrier material between two blotters and feed through a press. The thickness of the resultant specimen is then measured with the target density of the specimen being 0.1 g/cm$^3$ which equals a thickness of 1.32 mm or 0.052" (i.e., 52 mils). The fiberization energy of the specimen may be calculated as described above based on energy measured and displayed by the Kamas Type H 01 Laboratory Defribrator (converted, if necessary from watt hours or wH), divided by the fiberized fiber weight, to provide a value in kJ/kg.

EXAMPLES

The fire resistance of fluff pulp webs, as well as air-laid fibrous structures prepared from such webs, are shown below:

Example 1

Fire Resistance of Fluff Pulp Specimens

Fluff pulp specimens are prepared according to the "Fire Resistance Test Specimen Preparation" procedure described above using International Paper's RW 160 fluff pulp. The Control specimen is fluff pulp which is not treated with any fire retardant or surfactant. Specimens 1-1 and 1-2 are fluff pulps which are treated with FRP 12™ fire retardant (from Cellulose Solutions, LLC) but without any surfactant treatment. Specimen 1-3 is fluff pulp which is treated with FR 8500™ (from Cellulose Solutions, LLC) fire retardant but without any surfactant treatment. Specimens 1-4 and 1-15 are fluff pulps which are treated with FRP 12™ fire retardant and with Eka Chemical F60™ surfactant. The Control, as well as Specimens 1-1 through 1-5 after treatment, are dried at 250° F. The results of the Control, as well as Specimens 1-1 through 1-5, in the Horizontal Burn Through test are shown in Table 1:

| Specimen | Control | 1-1 | 1-2 | 1-3 | 1-4 | 1-5 |
|---|---|---|---|---|---|---|
| Fire Retardant (FR) | None | FRP 12 | FRP 12 | FR 8500 | FRP 12 | FRP 12 |
| FR Dose (lbs/ton) | 0 | 332 | 332 | 83 | 83 | 60 |

-continued

| Specimen | Control | 1-1 | 1-2 | 1-3 | 1-4 | 1-5 |
|---|---|---|---|---|---|---|
| Surfactant (lbs/ton) | 0 | 0 | 0 | 0 | 3 | 3 |
| Burn Time (min.) | 1.2 | >15 | 0.38 | 3.2 | >15 | 14.5 |

Example 2

Fire Resistance of Air-Laid Fibrous Structure Specimens

Specimens of air-laid fibrous structures are prepared which comprise 88% fluff pulp fibers (from International Paper's RW 160 fluff pulp) and 12% bicomponent fibers (Trevira® 255 from Trevira GmbH, Bobingen, Germany, having a polyethylene core/polyethylene sheath). The Control specimen uses fluff pulp fibers which are not treated with any fire retardant or surfactant. Specimens 2-1, 2-2 and 2-3 used fluff pulp fibers treated with FR 165™ (from Cellulose Solutions, LLC) fire retardant (at 60 lbs/ton) and Eka Chemical F60™ surfactant (at 2 lbs/ton). After forming the air-laid fibrous structures, the Control and Specimen 2-2 are subjected to surface treatment with FR 165™ fire retardant (from Cellulose Solutions, LLC) at 60 lbs/ton, while Specimen 2-3 is subjected to surface treatment with FR 165™ fire retardant at 40 lbs/ton. The results of the Control, as well as Specimens 2-1, 2-2, and 2-3, in the UL 94 TMVB test (VTM-0 criteria) are shown in Table 2:

TABLE 2

| Specimen | Control | 2-1 | 2-2 | 2-3 |
|---|---|---|---|---|
| Fire Retardant/Surfactant Treatment of Pulp | No | Yes | Yes | Yes |
| Air-Laid Structure Grammage (g/cm$^2$) | 410 | 375 | 375 | 375 |
| Caliper (mils) | 375 | 405 | 405 | 405 |
| Surface Treatment with Fire Retardant (lbs./ton) | 60 | 0 | 60 | 40 |
| UL 94 TMVB Test | Fail (full burn) | Fail | Pass | Fail (2 of 3 runs) |

The VTM-0 criteria (see paragraph 11.1.3, Table 11.1, at page 24 of UL 94 "Tests for Flammability of Plastic Materials for Parts in Devices and Appliances" published by Underwriters Laboratories Inc., Standard for Safety (2009)) used (for the 5 specimens tested) are shown in Table 3 below:

TABLE 3

| Criteria Conditions | Criteria |
|---|---|
| Afterflame time for each individual specimen $t_1$ or $t_2$ | ≤10 seconds |
| Total afterflame time for any condition set ($t_1$ plus $t_2$) for the 5 specimens | ≤50 seconds |
| Afterflame plus afterglow time for each individual specimen after the second flame application ($t_1 + t_2$) | ≤30 seconds |
| Afterflame or afterglow of any specimen burned up to 125 mm mark | No |
| Cotton indicator ignited by flaming particles or drops | No |

$t_1$ = afterflame time after first flame application
$t_2$ = afterflame time after second flame application
$t_3$ = afterglow time after second flame application All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising a fire resistant fluff pulp web comprising:

a fluff pulp web comprising above about 45% unrefined softwood fibers and having:
- a basis weight above about 40 gsm;
- a caliper of at least about 30 mils;
- a fiberization energy of less than about 170 kJ/kg; and
- a moisture content of less than about 16%; and a fire retardant component present in and/or on the fluff pulp web in an amount of up to about 150 lbs fire retardant component per ton of the fluff pulp web, the fire retardant component comprising:
- from about 50 to about 98.5% by weight of the fire retardant component of one or more retardants; and
- from about 1.5 to about 50% by weight of the fire retardant component of one or more organic amine fire retardant dispersants; and one or more fire retardant distributing surfactants which distribute the fire retardant component in and/or on the fluff pulp web;

wherein the fire retardant component is in an amount and is distributed in and/or on the fluff pulp web in a manner so that the fire resistant fluff pulp web passes one or more of the following tests: the UL 94 TMVB test, or the Horizontal Burn Through test.

2. The article of claim 1, wherein the fluff pulp web comprises above about 45% unrefined softwood fibers.

3. The article of claim 2, wherein the fluff pulp web comprises above about 75% unrefined softwood fibers.

4. The article of claim 1, wherein the fluff pulp web has a basis weight above about 135 gsm.

5. The article of claim 4, wherein the fluff pulp web has a basis weight above about 200 gsm.

6. The article of claim 1, wherein the fluff pulp web has fiberization energy of less than about 135 kJ/kg.

7. The article of claim 6, wherein the fluff pulp web has fiberization energy of less than about 129 kJ/kg.

8. The article of claim 1, wherein the fluff pulp web has a caliper of from about 30 to about 85 mils.

9. The article of claim 8, wherein the fluff pulp web has a caliper of from about 45 to about 65 mils.

10. The article of claim 1, wherein the fluff pulp web has a moisture content of less than about 12%.

11. The article of claim 10, wherein the fluff pulp web has a moisture content of about 7% or less.

12. The article of claim 1, wherein the one or more fire retardants comprise: one or more phosphorous fire retardants, one or more halogenated hydrocarbon fire retardants, or one or more metal oxide fire retardants.

13. The article of claim 12, wherein the one or more fire retardants comprise, by weight of the total fire retardant: from about 50 to 100% of the one or more phosphorous fire retardants, from 0 to about 10% of the one or more halogenated hydrocarbon fire retardants, and from 0 to about 40% of the one or more metal oxide fire retardants.

14. The article of claim 13, wherein the one or more fire retardants comprise a mixture of, by weight of the total fire retardant: from about 50 to 95% of the one or more phosphorous fire retardants, from about 1 to about 10% of the one or more halogenated hydrocarbon fire retardants, and from about 4 to about 40% of the one or more metal oxide fire retardants.

15. The article of claim 14, wherein the mixture of one or more fire retardants comprises ammonium phosphates, halogenated alkanes, and antimony trioxide.

16. The article of claim 1, wherein the fire retardant component comprises: from about 80 to about 95% by weight of the fire retardant component of the one or more fire retardants; and from about 5 to about 20% by weight of the fire retardant component of the one or more organic amine fire retardant dispersants.

17. The article of claim 16, wherein the one or more organic amine fire retardant dispersants comprises one or more debonder surfactants.

18. The article of claim 17, wherein the one or more organic amine fire retardant dispersants comprises one or more of: linear or branched monoalkyl amines, linear or branched dialkyl amines, linear or branched tertiary alkyl amines, linear or branched quaternary alkyl amines, fatty acid amide quaternary ammonium salts, dialkyl dimethyl quaternary ammonium salts, dialkylimidazolinium quaternary ammonium salts, dialkyl ester quaternary ammonium salts, triethanolamine-ditallow fatty acids, fatty acid ester of ethoxylated primary amines, or ethoxylated quaternary ammonium salts.

19. The article of claim 1, wherein the one or more fire retardant distributing surfactants are in a weight ratio to the fire retardant component of from about 1:5 to about 1:40.

20. The article of claim 19, wherein the one or more fire retardant distributing surfactants are in a weight ratio to the fire retardant component of from about 1:10 to about 1:20.

21. The article of claim 20, wherein the fire retardant distributing surfactant comprises: one or more ethoxylated alcohols.

22. The article of claim 21, wherein the one or more ethoxylated alcohols comprise from about 1 to about 30 ethylene oxide units and an alcohol carbon chain length of from about 6 to about 30 carbon atoms.

23. The article of claim 22, wherein the one or more ethoxylated alcohols comprise from about 4 to about 25 ethylene oxide units and an alcohol carbon chain length of from about 6 to about 22 carbon atoms.

24. The article of claim 23, wherein the alcohol carbon chain length is from about 12 to about 18 carbon atoms.

25. The article of claim 24, wherein the alcohol carbon chain length is from about 16 to about 18 carbon atoms.

26. The article of claim 1, wherein the fire retardant component is in an amount in the range of from about 55 to about 90 lbs fire retardant component per ton of the fluff pulp web.

27. The process of claim 26, wherein the fire retardant component is in an amount in the range of from about 60 to about 70 lbs fire retardant component per ton of the fluff pulp web.

* * * * *